US008146762B2

(12) United States Patent
Leoncavallo et al.

(10) Patent No.: US 8,146,762 B2
(45) Date of Patent: Apr. 3, 2012

(54) FLEXIBLE CONTAINER HANDLING SYSTEM

(75) Inventors: Richard A. Leoncavallo, Niagara Falls, NY (US); Peter K. Baird, Honeoye Falls, NY (US)

(73) Assignee: Nalge Nunc International Corporation, Rochester, NY (US)

( * ) Notice: Subject to any disclaimer, the term of this patent is extended or adjusted under 35 U.S.C. 154(b) by 627 days.

(21) Appl. No.: 11/683,838

(22) Filed: Mar. 8, 2007

(65) Prior Publication Data

US 2007/0209960 A1 Sep. 13, 2007

Related U.S. Application Data

(60) Provisional application No. 60/743,446, filed on Mar. 9, 2006.

(51) Int. Cl.
*B65D 6/28* (2006.01)

(52) U.S. Cl. ..... 220/4.24; 220/4.27; 220/495.06; 220/23.83; 206/509; 206/508

(58) Field of Classification Search ..... 220/4.21, 220/4.24, 4.27, 495.06, 23.83, 769, 770; 206/509, 508, 511, 505, 504
See application file for complete search history.

(56) References Cited

U.S. PATENT DOCUMENTS

| | | | | |
|---|---|---|---|---|
| 2,794,570 | A | 6/1957 | Downs | |
| 3,133,677 | A | 5/1964 | Bertels | |
| 3,244,311 | A * | 4/1966 | Lawson | 220/4.21 |
| 3,265,254 | A | 8/1966 | Carter et al. | |
| 3,616,943 | A * | 11/1971 | Brink | 206/508 |
| 4,869,398 | A | 9/1989 | Colvin et al. | |
| 4,974,738 | A | 12/1990 | Kidd et al. | |
| 4,993,579 | A | 2/1991 | Burchett | |
| 5,197,601 | A * | 3/1993 | Sterett | 206/511 |
| 5,249,684 | A * | 10/1993 | Sterett | 206/503 |
| 5,332,114 | A * | 7/1994 | Sano et al. | 220/4.24 |
| 5,361,906 | A * | 11/1994 | Sterett | 206/509 |
| 5,405,000 | A * | 4/1995 | Hagedon et al. | 206/216 |
| 5,431,496 | A | 7/1995 | Balteau et al. | |
| 5,465,865 | A | 11/1995 | Coombes | |
| 5,507,904 | A | 4/1996 | Fisher et al. | |
| 5,555,996 | A * | 9/1996 | Lang-Ree et al. | 220/495.01 |
| 5,560,403 | A | 10/1996 | Balteau et al. | |

(Continued)

FOREIGN PATENT DOCUMENTS

DE 4308383 A1 9/1993

(Continued)

OTHER PUBLICATIONS

European Patent Office, Search Report and Written Opinion of Corresponding PCT/US2007/063689, dated Aug. 24, 2007.

(Continued)

*Primary Examiner* — Mickey Yu
*Assistant Examiner* — Kareen Rush
(74) *Attorney, Agent, or Firm* — Wood, Herron & Evans, LLP

(57) ABSTRACT

A container for a flexible bag of liquid that supports the bag during transportation, storage and use in dispensing of the liquid. The container is made from two generally similar pans that form lower and upper parts of the container. Each pan includes a plurality of generally similar multiple projections that function to support the container on a surface as well as in a stable stacked formation.

24 Claims, 24 Drawing Sheets

U.S. PATENT DOCUMENTS

| | | | | |
|---|---|---|---|---|
| 5,613,622 | A | 3/1997 | Surrena et al. | |
| D385,943 | S | 11/1997 | Voelker | |
| 5,813,531 | A * | 9/1998 | Kao | 206/373 |
| 5,988,422 | A | 11/1999 | Vallot | |
| 6,019,241 | A * | 2/2000 | Burns | 220/570 |
| 6,076,457 | A | 6/2000 | Vallot | |
| 6,186,932 | B1 | 2/2001 | Vallot | |
| 6,659,132 | B2 | 12/2003 | Smith et al. | |
| 6,729,369 | B2 | 5/2004 | Neas et al. | |
| 6,764,482 | B2 | 7/2004 | Keilman et al. | |
| 6,769,231 | B2 | 8/2004 | Danby | |
| 6,889,838 | B2 * | 5/2005 | Meier et al. | 206/508 |
| 6,988,633 | B2 * | 1/2006 | Grinnall et al. | 220/770 |
| 7,341,148 | B2 * | 3/2008 | Bettenhausen et al. | 206/370 |
| 7,360,665 | B1 * | 4/2008 | Hartelius | 220/759 |
| 2002/0121527 | A1 | 9/2002 | Good | |
| 2003/0017066 | A1 | 1/2003 | Danby et al. | |
| 2003/0198406 | A1 | 10/2003 | Bibbo et al. | |
| 2004/0096126 | A1 | 5/2004 | Danby et al. | |
| 2004/0107150 | A1 | 6/2004 | Neas et al. | |
| 2004/0144799 | A1 | 7/2004 | Danby et al. | |
| 2004/0144800 | A1 | 7/2004 | Danby et al. | |
| 2004/0221897 | A1 | 11/2004 | Schubmehl et al. | |

FOREIGN PATENT DOCUMENTS

| | | | |
|---|---|---|---|
| DE | 29703691 | U1 | 7/1997 |
| FR | 2449429 | A1 | 9/1980 |
| GB | 2046081A | A | 11/1980 |
| WO | WO96/23703 | A | 8/1996 |
| WO | WO02/092462 | A | 11/2002 |

OTHER PUBLICATIONS

European Patent Office, European Search Report, Application No. 11150891.7, mailed Apr. 19, 2011 (7 pages).

European Patent Office, European Search Report, Application No. EP 11 16 8533, mailed Sep. 15, 2011 (5 pages).

* cited by examiner

FLEXIBLE CONTAINER HANDLING SYSTEM

RELATED APPLICATIONS

The present application claims the filing benefit of U.S. Provisional Application Ser. No. 60/743,446, filed Mar. 9, 2006, the disclosure of which is incorporated herein by reference in its entirety.

FIELD

This invention relates generally to containers and more particularly, to a system for transporting, storing and handling containers.

BACKGROUND

It is known to store, ship and dispense liquids in collapsible and flexible impervious bags, bladders or containers made from plastic or other polymeric materials. Further, bags of liquids are used in a wide range of industrial and medical applications, including without limitation, containment of cell culture medium, reagents, wash solutions, water and pharmaceutical. Such bags of liquids range in size from fractions of a liter to a thousand liters in volume. In many applications, the liquids in the flexible bags are very expensive and any loss in storage, transportation or usage is costly. The flexible bags are used because they can reliably store liquids without contamination and are relatively inexpensive. However, a flexible bag of liquid, especially a larger one, is very unwieldy and difficult to physically handle and is subject to damage by the rigors of transportation.

To protect a flexible bag of liquid during storage and transportation, it is placed inside a container that, depending on the application, is made of cardboard, plastic, stainless steel or other material. In many applications, the flexible bags of liquid are placed in a shipping container and surrounded by packing material to protect the flexible bag during shipment. Prior to use, the flexible bag is removed from the shipping container and placed in another container, for example, a tote, tray, rack or cart. That container may be suitable for stacking, autoclaving and/or storage. In some applications, the flexible bag is placed in a third, different container that supports the flexible bag while liquid is being dispensed from the bag. The use of multiple containers to transport, store and dispense the liquid is costly, labor intensive and subjects the flexible bag to damage as it is moved from one container to another.

It is also known to use a common container to support a flexible bag of liquid during transportation, storage and use; however, such containers are generally designed for, and limited to, a particular application and are not suitable for use in other industrial and laboratory settings. For example, it is known to transport, store and dispense beer from flexible bags located in stackable steel barrels. It is also known to place flexible bags of liquid in cardboard boxes that can be stacked during transportation, storage and use of the liquid media from the flexible bag. While a cardboard box has some rigidity and may be suitable for smaller bags, it may not be suitable for larger volume containers of liquid; and cardboard is generally considered unsuitable for use in a sterile or "clean" environment.

Consequently, there is a need for a container for a flexible bag of liquid that overcomes the disadvantages identified above.

SUMMARY

The present invention overcomes the foregoing and other shortcomings and drawbacks of containers heretofore known for supporting flexible bags of liquids during transportation, storage and use. While the invention will be described in connection with certain embodiments, it will be understood that the invention is not limited to these embodiments. On the contrary, the invention includes all alternatives, modifications and equivalents as may be included within the spirit and scope of the present invention.

The present invention provides a container for a flexible bag of liquid that supports the bag during transportation and storage as well as during a dispensing operation. The container may also interlock with other containers in a stacked formation that is very stable whether stacked on a generally horizontal surface, or stacked on an inclined surface to facilitate a gravity dispensing. In addition, the shape, size and cross-sectional thickness of the container may be scaled up or down to accommodate different sizes and shapes of flexible bags of liquid. Further, the container may be made of a material that is suitable for use in sterile and "clean" environments. In some applications, the container may be made by vacuum forming a plastic sheet material and therefore, is relatively inexpensive and, optionally, disposable. In addition, in an exemplary embodiment, when not in use, container components may be nested in a space-saving manner.

In accordance with the principles of the present invention and in accordance with the described embodiments, the present invention provides a pan usable to form generally identical lower and upper parts of a container for holding a flexible bag of liquid. When used as a lower part of the container, the pan has projections extending outward from an outer surface, which are used to support the pan on a support surface. When the pan is used as an upper part of the container, the projections face away from the support surface and facilitate alignment with a second container in a stacked formation on the support surface. The projections on the first container extend between projections on the second container to provide a more stable stacked formation. In different aspects of this embodiment, the projections may be either substantially parallel ribs or a plurality of legs and associated notches.

In further embodiments, the pan further includes other projections extending outward from the outer surface. When the pan is used as an upper part of the first container, the other projections face away from the support surface and facilitate alignment with the second container in the stacked formation on the support surface. The other projections also help to stabilize the second container with respect to the first container in the stacked formation. In further embodiments, the pan has first structure for holding the flexible bag of liquid inside the container and additional structure for holding two pans forming the container together. The pans may be nested and stacked when not in use.

In still further embodiments, a container for supporting a flexible bag of liquid has substantially similar lower and upper parts. The lower part has first projections extending downward from an outer surface to support the lower part on a surface. The upper part is placed over the lower part to form an interior space for holding the flexible bag of liquid. The upper part has second projections extending upward from an outer surface. The second projections are locatable adjacent to, and facilitate alignment with, first projections of another container in a stacked formation. In different embodiments of this invention, the container may include handles and/or connectors for securing the lower and upper parts together.

These and other objects and advantages of the present invention will become more readily apparent during the following detailed description together with the drawings herein.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
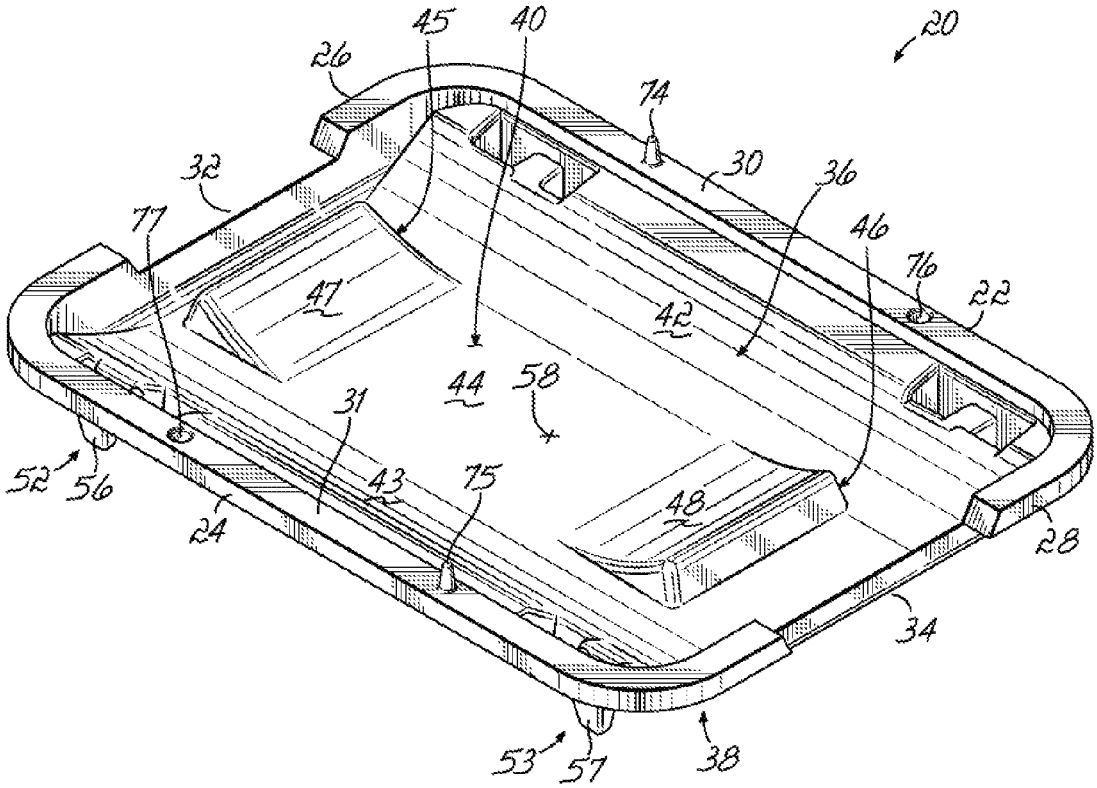
FIG. 1 is a perspective view of an exemplary embodiment of a pan used to make a container for supporting a flexible bag.
Figure 2:
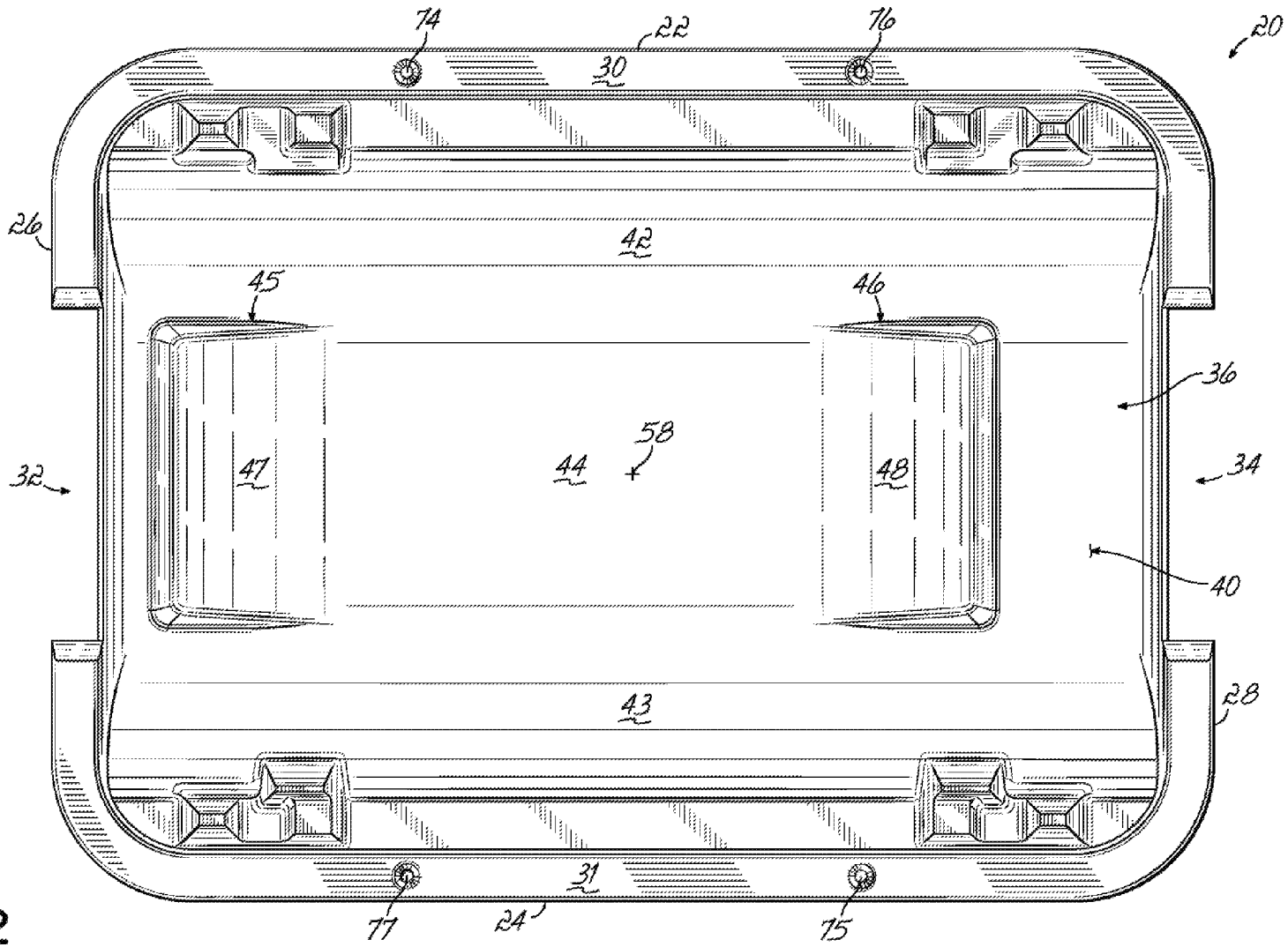
FIG. 2 is a plan view of an inner side of the exemplary embodiment of the pan for supporting a flexible bag as shown in FIG. 1.

Referring to FIGS. 1 and 2, one embodiment of a pan 20 has opposed lateral edges 22, 24 and opposed ends 26, 28. The periphery of the pan 20 is defined by the generally parallel lateral edges 22, 24 and generally parallel ends 26, 28. The ends 26, 28 are generally perpendicular to the lateral edges 22, 24 and thus, the pan 20 has a quadrilateral shape that is specifically rectangular. Peripheral edge surfaces 30, 31 extend the full length of the lateral edges 22, 24 and along portions of the ends 26, 28. Centrally located spaces 32, 34 are located in the respective ends 26, 28 and interrupt opposed edge surfaces 30, 31.

The pan 20 has an inner directed surface or side 36 and an opposed outer directed surface or side 38. The inner directed side 36 has a cavity or depression 40 formed with respect to inner edge surfaces 30, 31. The depression 40 has lateral angular inner sloping side walls 42, 43, a portion of which intersect a generally flat, centrally located surface 44. End projections 45, 46 extend outward and away from the inner side 36 and are shaped to form angular and inward sloping end walls 47, 48, which are generally perpendicular to the angular side walls 42, 43 and also intersect the central surface 44. The angular side walls 42, 43, angular end walls 47, 48 and intermediate surface 44 are generally configured to conform to the sides and ends of a flexible bag filled with a liquid. The angular side walls 42, 43 are generally parallel as are the angular end walls 47, 48.

Referring to FIGS. 1 and 3-5, the outer side 38 is also peripherally defined by the lateral edges 22, 24 and ends 26, 28. First multiple projections, 51 extend outward from the outer side 38 adjacent the lateral edge 22, and second multiple projections 52, 53 extend outward from the outer surface 38 adjacent the second lateral edge 24. The first multiple projections 50, 51 are generally identical in size and shape and provide respectively first legs 54, 55 and first short projections 64, 65. The second multiple projections 52, 53 are also generally identical in size and shape and provide respectively second legs 56, 57, second short projections 66, 67 and long other projections 72, 73.

The legs 54, 55, 56, 57 are designed to contact a surface 92 onto which the pan 20 is placed; and the legs support the weight of the pan 20, a flexible bag filled with a liquid supported by the pan as well as other structure that may be stacked on top of the pan 20. The pair of legs 54, 56, is symmetrical with respect to, and equally spaced from, a center point 58 of the pan 20; and the pair of legs 55, 57 is also equally spaced from, and symmetrical with respect to, the pan center point 58. However, the pair of legs 54, 56 does not have to have the same symmetry with the pan center point 58 as the pair of legs 55, 57, but they may have. It should be noted that the center point 58 of the pan 20 is also a center point of the inner side 36 and the outer side 38.

The first short projections 64, 65 extend outward from the outer surface 38 adjacent the lateral edge 22, and the second short projections 66, 67 extend outward from the outer surface 38 adjacent the lateral edge 24. A generally J-shaped locating notch 68 is formed between the leg 54 and the short projection 64, and a generally J-shaped locating notch 69 is formed between the leg 55 and the short projection 65. Similarly, a generally J-shaped locating notch 70 is formed between the leg 56 and the short projection 66, and a generally J-shaped locating notch 71 is formed between the leg 57 and the short projection 67.

The other projections 72, 73 also extend outward from the outer surface 38 adjacent the lateral edge 22. In this exemplary embodiment, the other projections 72 73 have a length generally equal to the legs 56, 57; but in other embodiments, the lengths of the other projections 72, 73 may be different than the lengths of the legs 56, 57.

Figure 3:
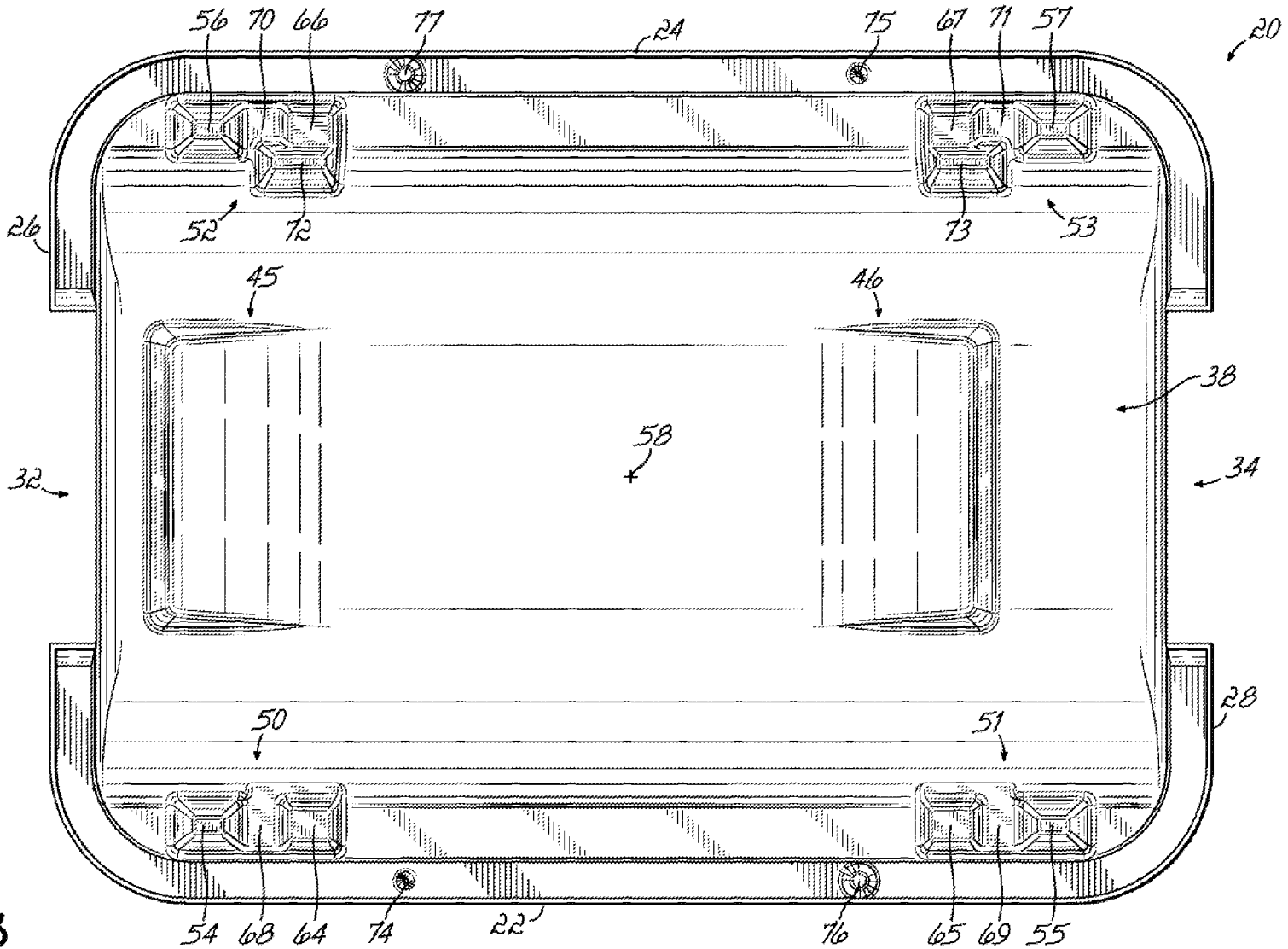
FIG. 3 is a plan view of an outer side of the exemplary embodiment of the pan for supporting a flexible bag shown in FIG. 1.
Figure 4:
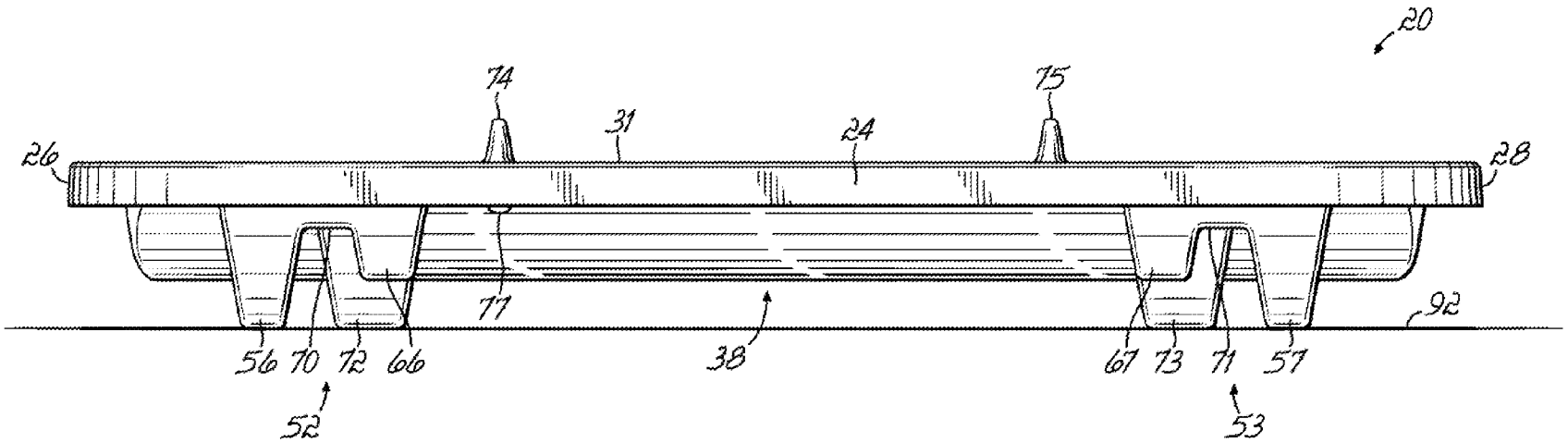
FIG. 4 is a side view in elevation of the exemplary embodiment of the pan for supporting a flexible bag shown in FIG. 1.
Figure 5:
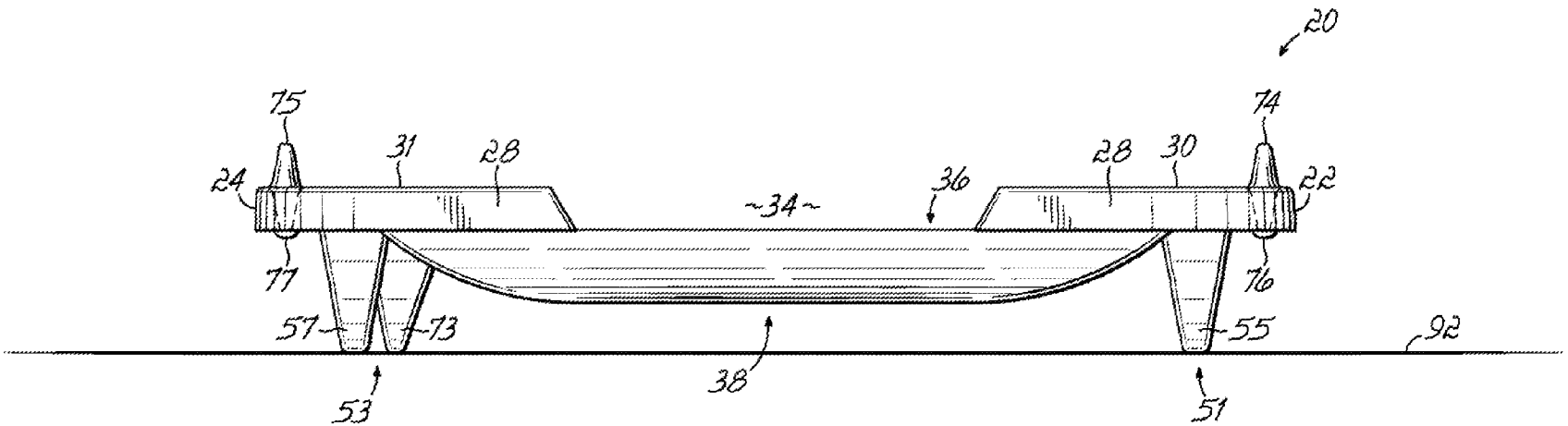
FIG. 5 is an end view in elevation of the exemplary embodiment of the pan for supporting a flexible bag shown in FIG. 1.

Referring to FIGS. 1-3, a first projection or pin 74 extends outward from the peripheral surface 30 along the lateral side 22, and a projection or second pin 75 extends outward from the peripheral surface 31 along the lateral side 24. A first depression, socket or hole 76 extends downward from the peripheral surface 30 along the lateral side 22, and a second depression, socket or hole 77 extends downward from the peripheral surface 31 along the lateral side 24. The pin 74 and hole 76 are equally spaced from, and symmetrical with respect to, the center point 58, and similarly, the pin 75 and hole 77 are also equally spaced from, and symmetrical with respect to, the center point 58. Although they may be, the pin 74 and socket 76 do not have to have the same symmetry with the pan center point 58 as the pin 75 and socket 77.

Figure 6:
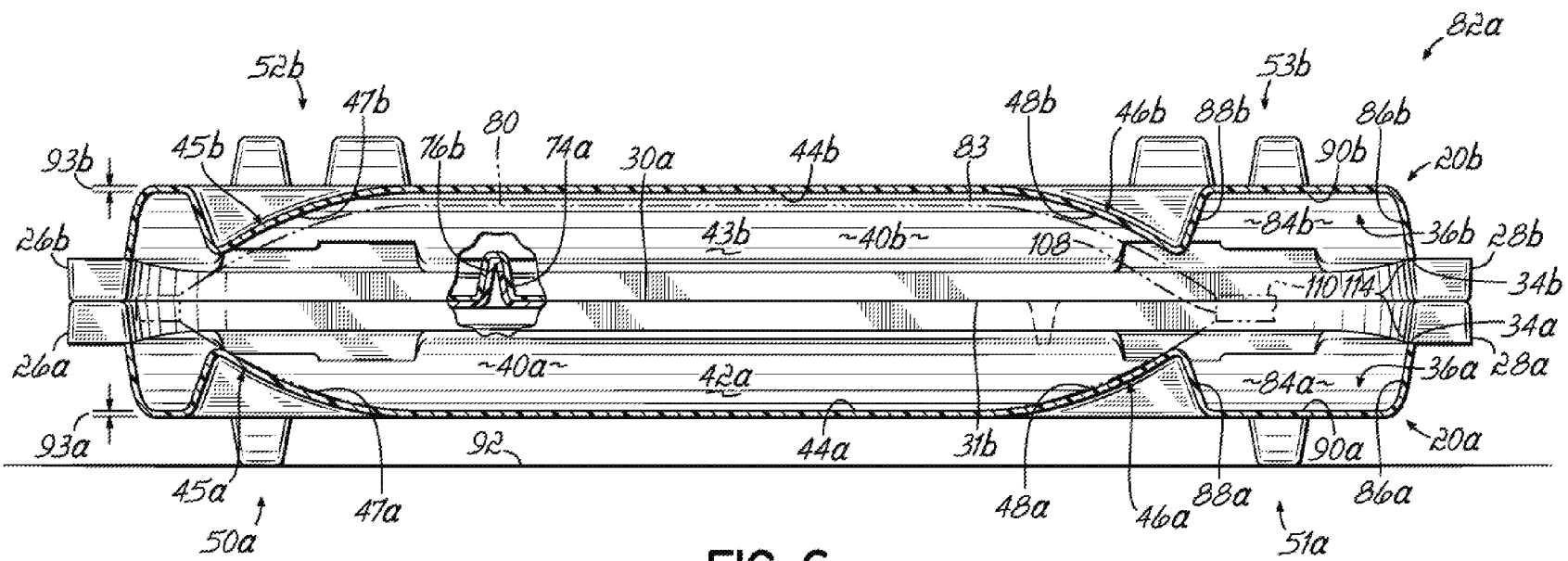
FIG. 6 is a cross-sectional view of an assembly of two pans as shown in FIG. 1 to form a container for a flexible bag of liquid.

In use, referring to FIG. 6, a flexible bag or bladder of liquid 80 is generally centrally located in a cavity 40*a* of a first pan 20*a*. Thereafter, a second pan 20*b* is placed over the first pan 20*a* so that cavity 40*b* faces the cavity 40*a*. The pans 20*a*, 20*b* are then brought together such that the pins are inserted into opposed holes, for example, as shown in FIG. 6, pin 74*a* of pan 20*a* is inserted in hole 76*b* of pan 20*b*. The pans 20*a*, 20*b* are further moved together until opposed edge surfaces are juxtaposed or contact each other, for example, as shown in FIG. 6, edge surface 30*a* of pan 20*a* contacts the edge surface 31*b* of pan 20*b*. In that process, the pins 74, 75 (FIGS. 3, 6) are pressed further into the holes 76, 77. In the exemplary embodiment, the pins 74 75 taper toward a distal end; and the holes 76, 77 taper toward a closed end. Thus, the process of inserting the pins 74, 75 into the holes 76, 77 helps to bring the pans 20*a*, 20*b* into alignment. Further, the size and taper of the pins 74, 75 and holes 76, 77 may be adjusted, so that the pins 74, 75 and holes 76, 77 are structure contacting the pans 20*a*, 20*b*, which is operable to maintain, and in some applications hold or secure, the pans 20*a*, 20*b* in the juxtaposed relationship.

When finally positioned in the juxtaposed relationship, the two opposed pans 20*a*, 20*b* form a container 82*a* for the flexible bag of liquid 80. The angular side walls 42*a*, 43*b*, angular end walls 47*a*, 47*b*, 48*a*, 48*b* and opposed central surfaces 44*a*, 44*b* define a volume 83 that is generally equal to, or larger than, a volume of a specific size of the flexible bag 80. Thus, if an application requires that the flexible bag of liquid 80 be frozen, the flexible bag has room to expand within the volume 83.

Within the pan 20*a*, a cavity 84*a* is formed on the inner side 36*a* between an end wall 86*a*, sidewall 88*a* of projection 48*a* and a bottom wall 90*a*. Similarly, within the pan 20*b*, a cavity 84*b* is formed on the inner side 36*b* between an end wall 86*b*, sidewall 88*b* of projection 48*b* and a bottom wall 90*b*. The cavities 84*a*, 84*b* are contiguous and provide a contained volume or space for storing tubing 110 and other paraphernalia connected to a port 108 at one end of the flexible bag of liquid 80. Access to the end of the bag 80, the port 108, and/or the tubing 110 is provided by an opening 114 formed in an end of the container 82*a* between the spaces 34*a*, 34*b* of the respective pans 20*a*, 20*b*.

Figure 7A:
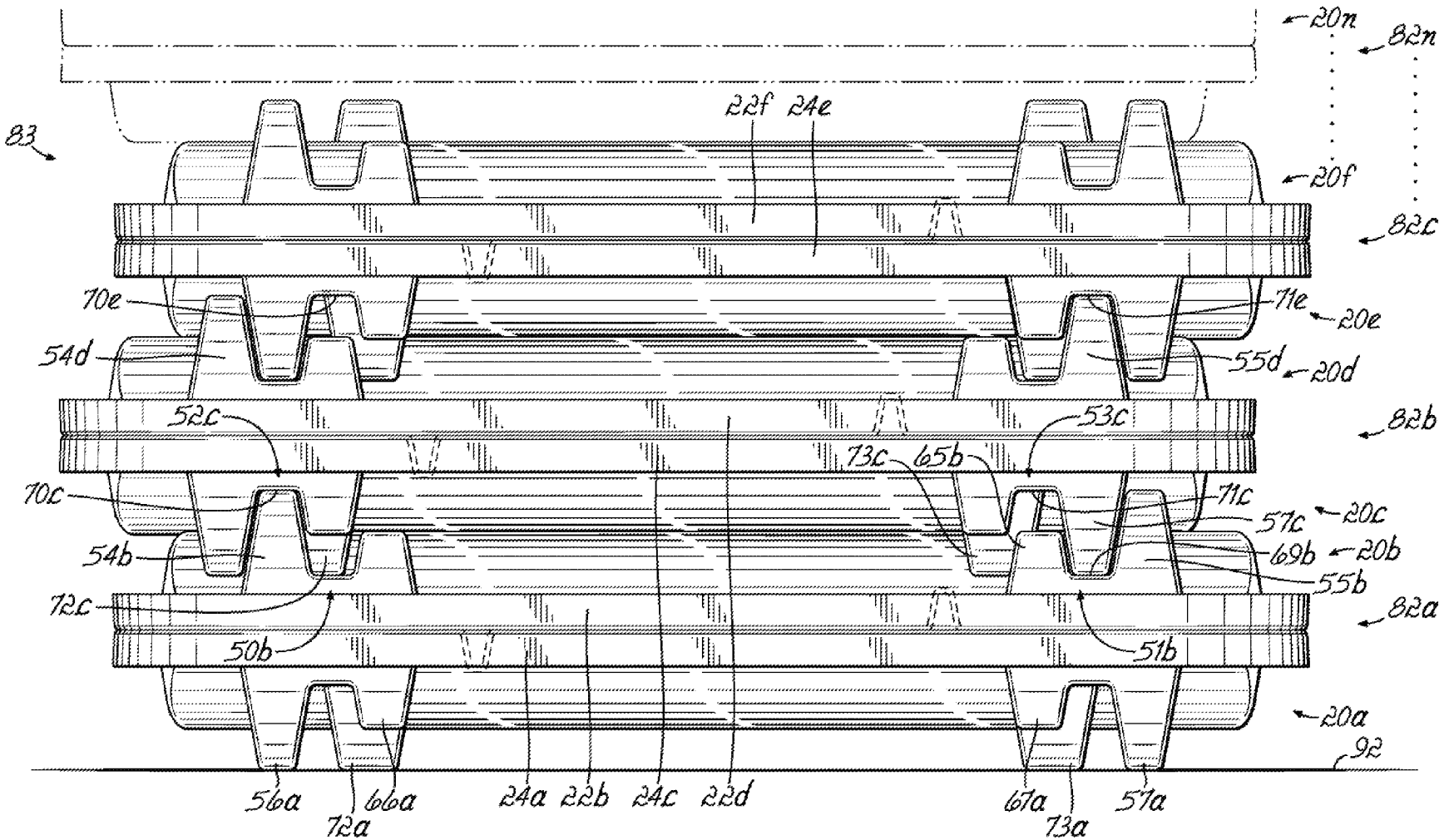
FIGS. 7A and 7B are opposed side elevation views of a stack of the containers illustrated in FIG. 6 supported on a generally horizontal surface.
Figure 7B:
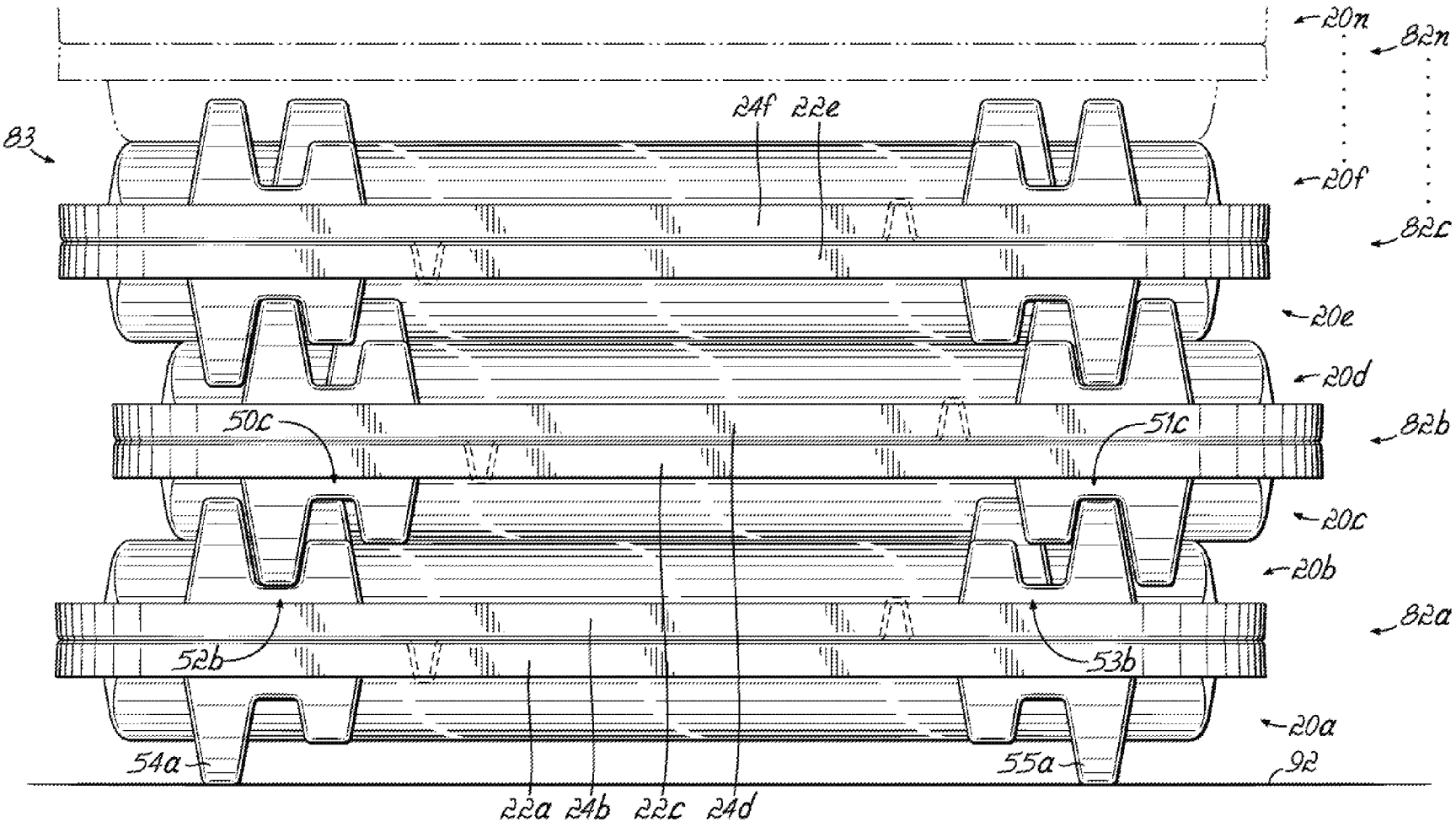

As shown in FIGS. 7A, 7B, containers 82*a*-82*n* formed by the pans 20*a*-20*n* may be stacked on a generally horizontal surface 92 to form a generally vertical stack 83. The container 82*n* and pan 20*n* are shown in phantom, and the notation "n" means that any number of respective containers and pans may be used in the stack 83. A similar meaning should be applied to other parts shown in phantom and identified with the notation "n". The legs 56*a*, 57*a* and other projections 72*a*, 73*a* extend downward from the pan 20*a* and contact a supporting surface 92. As shown in FIG. 7A, the shape of the multiple projections 50*b*, 51 *b*, 52*c*, 53*c* of the pans 20*b*-20*c* facilitate a stable stacking of containers 82*a*-82*b*. Upon stacking a second container 82*b* on the first container 82*a*, upward projecting leg 54*b* of container 82*a* locates in notch 70*c* of container 82*b*. Further, downward projecting leg 57*c* of container 82*b* locates in notch 69*b* of container 82*a*. Thus, the container 82*b* is prevented from sliding longitudinally, that is, leftward or rightward as viewed in FIG. 7A, with respect to container 82*a*. In addition, the longer projection 73*c* is located behind the short projection 65*b*; and the other projection 72*c* is located behind leg 54*b*. Thus, the relative locations of the other projections 72*c*, 73*c* prevent the container 82*b* from moving in a generally lateral horizontal direction, that is, in a direction generally perpendicular to the longitudinal direction, with respect to container 82*a*. In a similar manner, a container 82*c* may be stacked on container 82*b*; and it is prevented from sliding longitudinally or laterally by a similarly interlocking relationships of the various legs and projections on the pans 20*b*, 20*c*.

FIG. 7A illustrates an interlocking relationship of various legs and projections along first sides of containers 82*a*-82*n*. Referring to FIG. 7B, a similar interlocking relationship of legs and projections is shown along opposite sides of the containers 82*a*-82*n*. In FIGS. 7A, 7B, the stacking of the containers 82*a*-82*n* is an alternate stacking. With an alternate stacking, referring to FIG. 7A, the leg 55*b* of lower container 82*a* is located outside of notch 71*c* of upper container 82*b*; but the leg 54*b* is located in the opposing upper container notch 70*c*. However, with the next stack, the relative locations of the legs is reversed. The leg 55*d* of lower container 82*b* is located in the notch 71*e* in upper container 82*c*; but the leg 54*d* is located outside the opposing upper container notch 70*c*. By alternating relative locations of the legs and notches with each successive container in the stack, alternate containers, such as containers 82*a*, 82*c*, are generally aligned; but an intermediate container, for example, container 82*b* is offset longitudinally by about a width of a leg. More specifically, container 82*b* is shifted or offset slightly to the left as shown in FIG. 7A. Even though adjacent containers are slightly offset, the containers 82*a*-82*n* stack in a generally vertical direction and are stable for storage and transportation.

Figure 8:
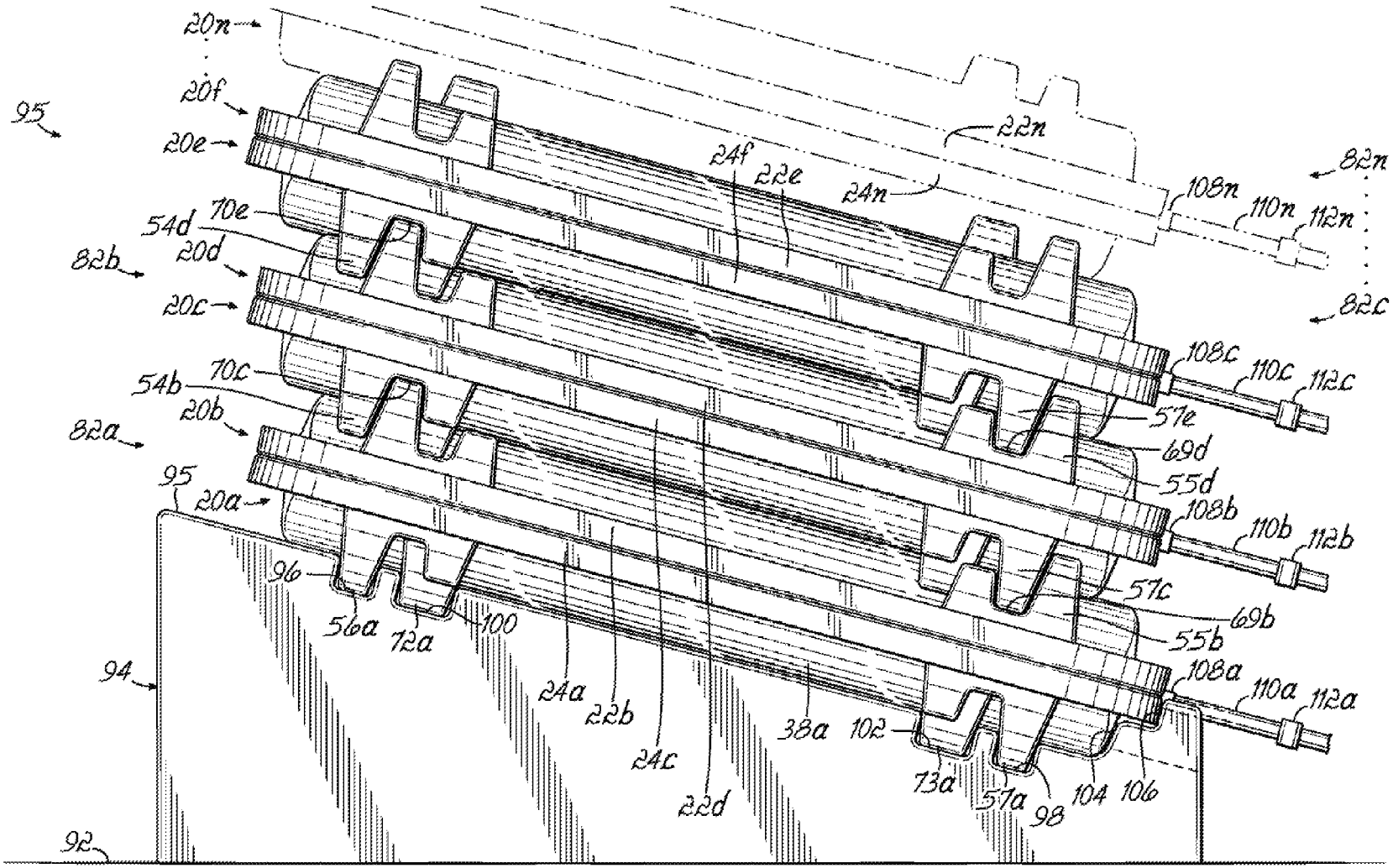
FIG. 8 is a side elevation view of a stack of the containers illustrated in FIG. 6 on an inclined surface.

In order to dispense liquid from the containers, as shown in the embodiment depicted in FIG. 8, the containers 82*a*-82*n* are placed in a stack 95 on an angled base 94 that is supported by surface 92. The base 94 has an angled or inclined upper surface 95 to facilitate a gravity dispensing of the liquid from the flexible bags 82*a*-82*n*. The upper surface 95 is contoured to generally mate with a profile of the outer side 38*a* of pan 20*a*. For example, the base 94 has notches or receptacles 96, 98 that receive respective legs 56*a*, 57*a*. Further notches or receptacles 100, 102 receive respectively other projections 72*a*, 73*a*. In addition, the base 94 has generally vertical surfaces 104, 106 that further prevent the pan 20*a* from sliding or moving with respect to the base 94.

The alternate stacking arrangement described and illustrated with respect to FIGS. 7A, 7B is very effective to establish and maintain a stable stack of containers 82*a*-82*n* for storage and transportation. However, if such a stacking arrangement were used when stacking containers on the inclined surface 95 of FIG. 8, the containers would extend forward of the base 94 in a less stable stack. Thus, an alternative, continuous offset stacking arrangement is shown in FIG. 8. With this continuous offset stacking arrangement, with each successive layer or row, legs 54*b*, 54*d* of lower respective containers 82*a*, 82*b* are located in respective slots 70*c*, 70*e* of respective upper containers 82*b*, 82*c*. Similarly, legs 57*c*, 57*e* of upper respective containers 82*b*, 82*c* are located in respective slots 69*b*, 69*d* of respective lower containers 82*a*, 82*b*. Thus, the containers 82*a*-82*n* are inhibited or prevented from sliding downward in an angular direction substantially parallel to the inclined surface 95. With this stacking arrangement, the forward edges of respective containers 82*a*-82*b* are maintained in a generally straight and generally vertical alignment. Such a stacking arrangement also generally maintains centers of gravity of respective containers 82*a*-82*n* in a generally straight and generally vertical alignment, which provides a stack of containers 82*a*-82*n* that is very stable when supported on the inclined surface 95.

Each of the flexible bags of liquid in the containers 82*a*-82*n* has one or more ports extending from one end, for example, ports 108*a*-108*n*. The ports 108*a*-108*n* may have any known implementation from simply a visual identity on an end of a bag to a connector attached to the end of the bag. At any time during a life cycle of a flexible bag of liquid, tubing 110*a*-110*n*, respective valves 112*a*-112*n* and/or other devices may be connected to respective ports 108*a*-108*n*, in a known manner. In many applications, the flexible bags of liquid are often supplied with associated respective tubing 110*a*-110*n* and respective valves 112*a*-112*n*. Further, with the embodiment of FIG. 8, the tubing 110*a*-110*n* may be connected on any combination of configurations that connect the tubing 110*a*-110*n* with external devices or with each other. For example, different ones of the tubing 110*a*-110*n* may be connected to separate devices that independently control a dispensing of liquids from respective containers 82*a*-82*n*. Alternatively, different ones of the tubing 110*a*-110*n* may be connected to a single device, for example, a peristaltic pump, that is used to control dispensing of one or more of the liquids. In other applications, different ones of the tubing 110*a*-110*b* may be connected together to connect respective ones of the containers 82*a*-82*n* together.

Figure 8A:
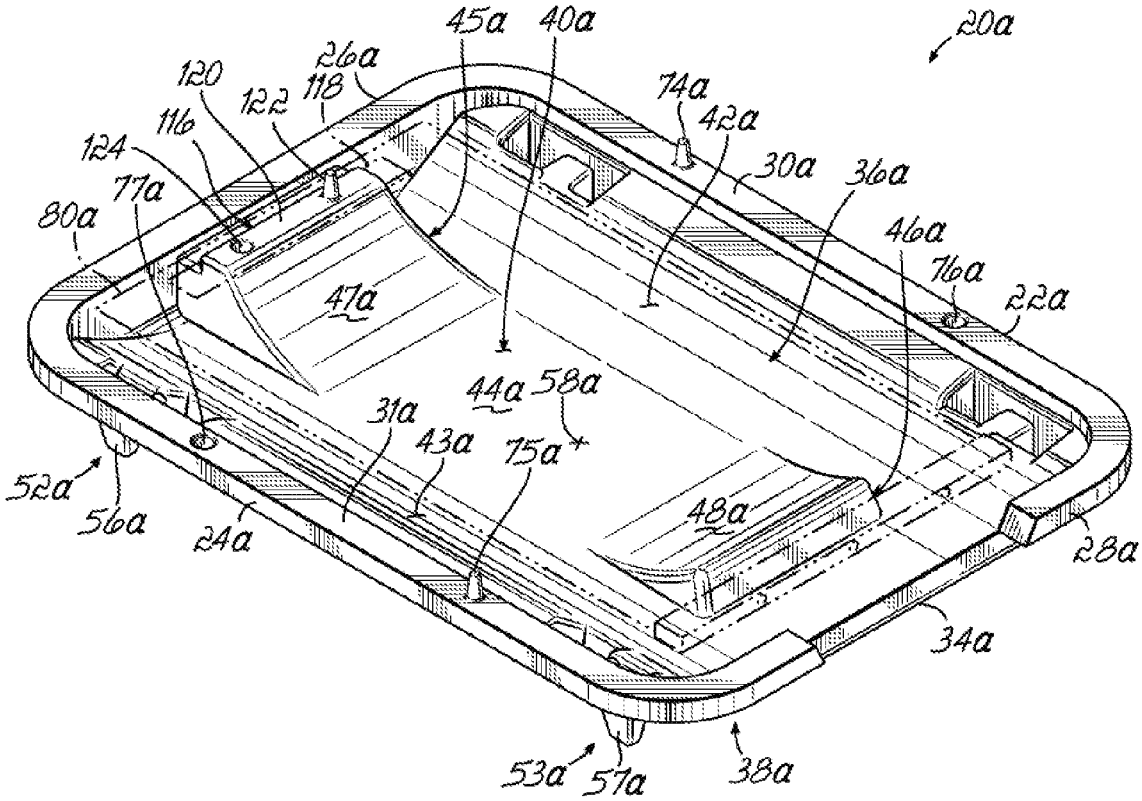
FIG. 8A is a perspective view of an alternative embodiment of a pan for supporting a flexible bag of liquid.

In the stacked formation of FIG. 8, there is a potential for flexible bags of liquid within the containers 82*a*-82*n* to slide downward in the containers, which may impair the smooth flow of liquid from a container in a dispensing process. Therefore, in a further embodiment, each of the pans 20*a*-20*n* has structure for holding respective flexible bags of liquid in place. Referring to FIG. 8A, in an exemplary embodiment illustrated with respect to pan 20*a*, a holding structure 116 secures a flexible bag of liquid 80*a*, shown in phantom, in a desired location. In many applications, a flexible bag of liquid 80*a* has an opening 118, shown in phantom, at an upper end; and the opening 118 is used to hang the bag 80*a* from a support during a dispensing operation. Further, the opening 118 may be of any configuration, for example, one or more holes, a slot as illustrated by the opening 118, or other suitable shape. The holding structure 116 has an end surface 120 generally coplanar with the peripheral surfaces 30*a* 31*a*. A projection or pin 122 extends outward from the end surface 120, and a depression, socket or hole 124 extends downward from the end surface 120. When the flexible bag of liquid 80*a* is placed in the pan 20*a*, the opening 118 is placed around the pin 122 and hole 124. Therefore, when another pan is brought into juxtaposition with pan 20*a* as described and shown herein with respect to FIGS. 6-8, the pin 122 is inserted into an opposing hole (not shown) in a manner similar to that described with respect to pin 74*a* and hole 76*b* shown in FIG. 6. Further, the hole 124 receives an opposing pin. Thus, when the pan 20*a* of FIG. 8A is placed in juxtaposition with an opposing pan, the pin 122 extending through the opening 118 of bag 80*a* holds the bag in a desired position with respect to the pan 20*a*. In addition, the end of the bag 80 is secured against the end surface 120 by an opposing end surface.

Figure 9:
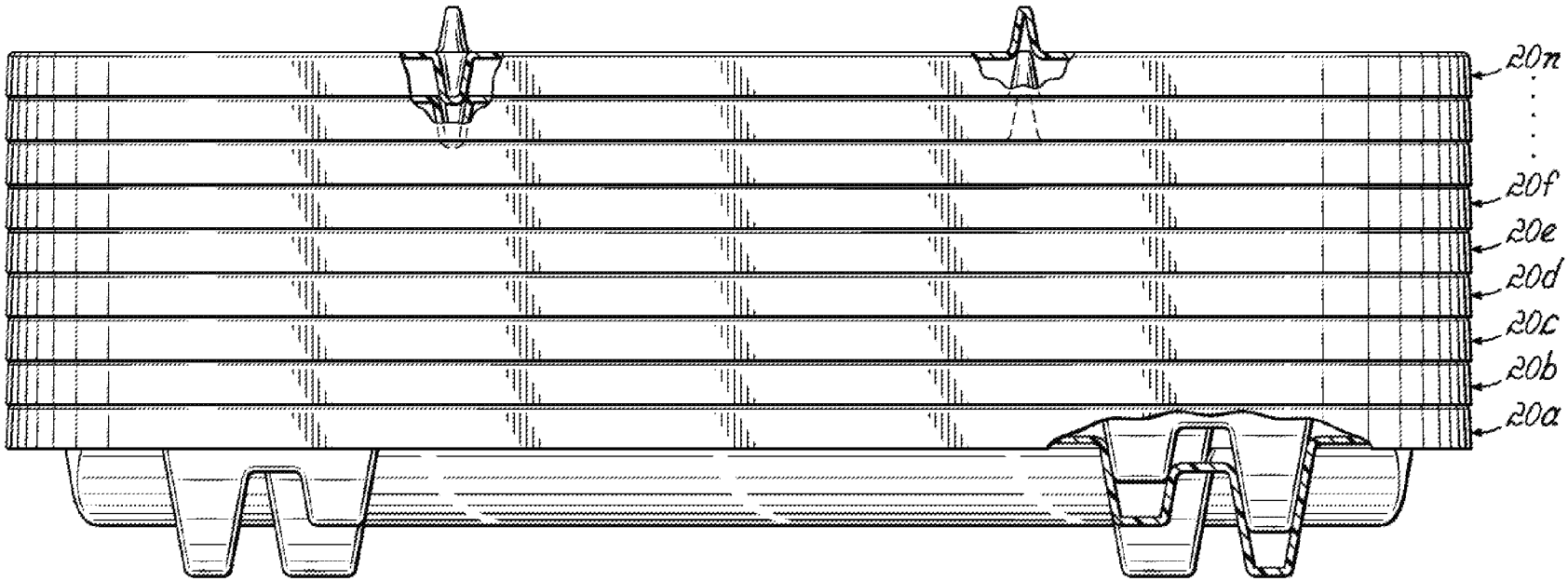
FIG. 9 is a side elevation view of an embodiment of a stack of the pans of FIG. 1.

As shown in FIG. 9, when not in use, the generally consistent cross-sectional thicknesses of the pans 20*a*-20*n* permit them to stack inside of each other in a very compact and efficient manner.

Figure 10:
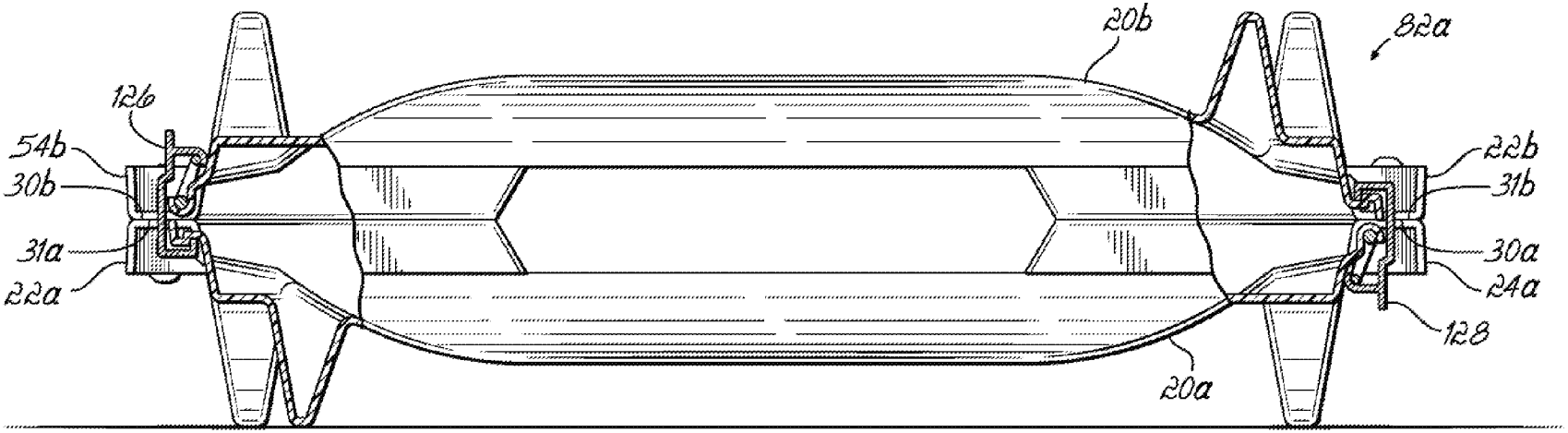
FIG. 10 is a side elevation view of an alternative embodiment of the container illustrated in FIG. 6, which has a clamp for securing together pans forming the container.

In some applications, referring to FIG. 10, it may be necessary that the lower and upper pans, for example, pans 20*a*, 20*b*, forming the container 82*a* be fastened or connected together. There are many alternative embodiments for securing the pans 20*a*, 20*b* into an integral container 82*a*. For example, an adhesive or bonding agent may be applied between the peripheral surfaces 31*a*, 30*b* and 30*a*, 31*b*, or the edges of the pans 20*a*, 20*b* may be welded together. In another embodiment, screws or other fasteners may be used to connect the peripheral surfaces 31*a*, 30*b* and 30*a*, 31*b*; and in a further embodiment, clamps 126, 128 may be used to hold the edges of the pans 20*a*, 20*b* together. Thus, depending on the fastening system used, the material used to make the pans 20*a*, 20*b*, the application of the flexible bag of liquid and other factors, the container 82*a* may be fabricated to be disposable or reusable.

The pan 20 of FIG. 1 described herein may be used to make a durable container 82*a* as shown in FIG. 6 for housing a flexible bag of liquid. The container 82*a* is suitable for storage and transportation without further protection. In addition, as shown in FIG. 7A, when stacked, various projections, for example, projections 52*c*, 53*c* of container 82*b*, extend downward between upward extending projections 50*b*, 51 *b* of an adjacent lower container 82*a*. Thus, adjacent ones of the stack of multiple containers 82*a*-82*n* are automatically interlocked, so that, the stack of containers 82*a*-82*n* is very stable for purposes of storage, transportation. In use, as shown in FIG. 8, the multiple containers 82*a*-82*n* may be stacked on an inclined surface 95 to facilitate a gravity dispensing of liquid from flexible bags inside respective containers. The structure of the pans 20*a*-20*n* permit the containers 82*a*-82*n* to be stacked in a substantially vertical orientation on the inclined surface 95. Thus, any point on one of the containers 82*a*-82*n* is on a generally vertical locus of points with similarly common points on others of the containers 82*a*-82*n*.

Figure 11:
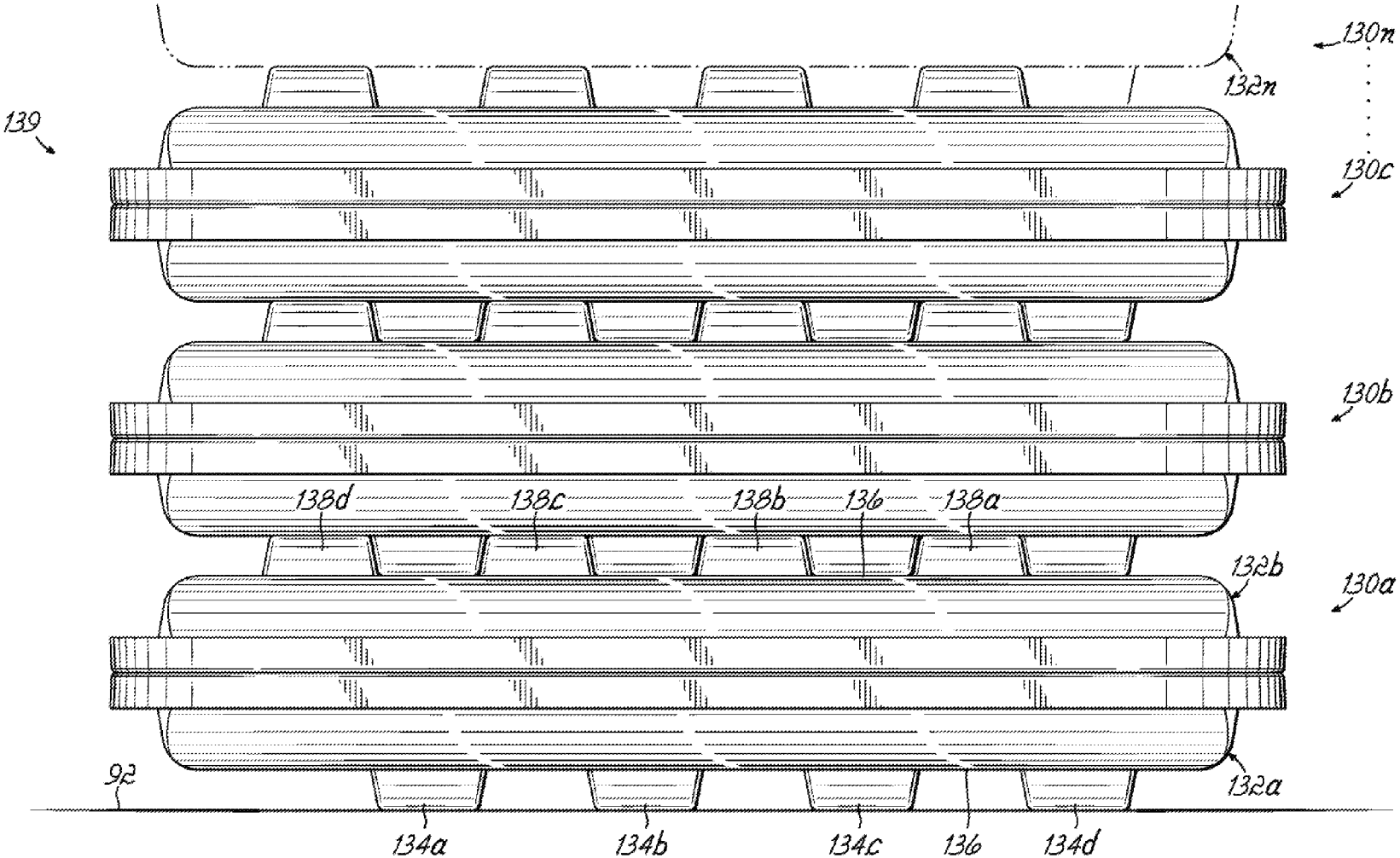
FIG. 11 is a side elevation view of a stack of containers on a horizontal surface, which have been made from another embodiment of pans.

In the exemplary embodiment of FIGS. 1-10, a pan 20 is used to form a container 82 having multiple projections 50-53 extending from an outer side 38. The multiple projections 50-53 provide four separate legs and associated projections to facilitate a stable alignment of the containers 82*a*-82*n* in a stacked formation on both horizontal and inclined surfaces. Referring to FIG. 11, in an alternative embodiment, container 130*a* is made from a lower pan 132*a* and an opposed upper pan 132*b*. The pan 132*a* has a plurality of projections, for example, elongated ribs 134*a*-134*d*, extending over an outer surface 136. The ribs 134*a*-134*d* are generally parallel and function to support the container 130*a* on a horizontal support surface 92. Each of the ribs 134*a*-134*d* may extend continuously across the outer surface 136 or may be comprised of discontinuous rib segments having a substantially linear locus across the outer surface 136.

Figure 12:
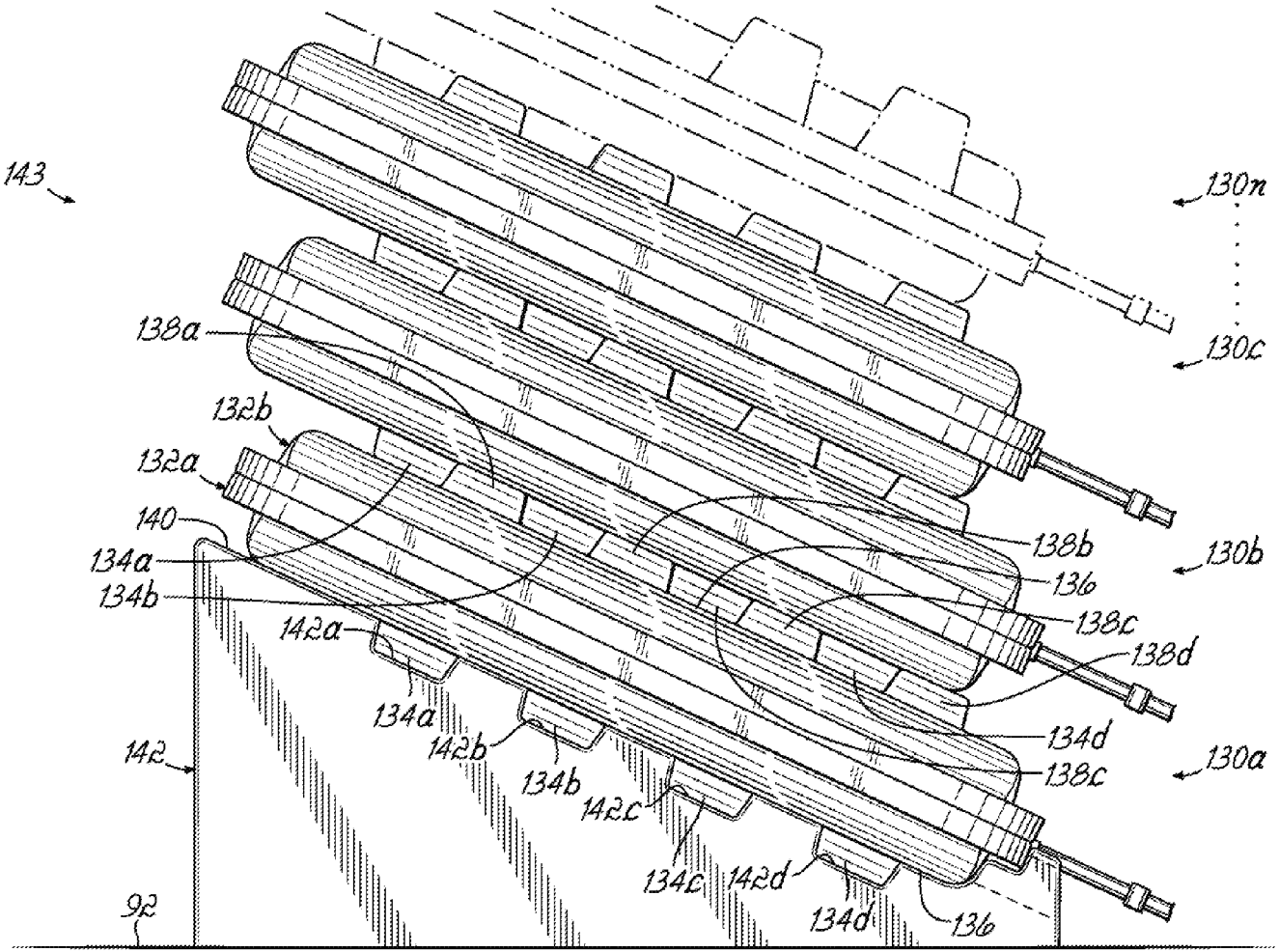
FIG. 12 is a side elevation view of a stack of containers on an inclined surface, which have been made from the other embodiment of the pans of FIG. 11.

The pan 132*b* also has a plurality of projections, for example ribs 138*a*-138*d*, which are generally parallel to each other as well as to the ribs 134*a*-134*d*. When the pans 132*a*, 132*b* are brought together to form the container 130*a*, center lines of the ribs 138*a*-138*d* are located substantially midway between center lines of the ribs 134*a*-134*d* of the pan 132*a*. Thus, the various ones of the ribs 134*a*-134*d* on the pan 132*c* fit between ribs 138*a*-138*d* on the pan 132*b*, thereby interlocking the containers 130*a*-130*b*. Thus, containers 130*a*-130*n* may be placed on top of each other to form a stable straight stack 139 on the generally horizontal surface 92, which is especially beneficial during transportation and storage, As shown in FIG. 12, to facilitate a gravity dispensing from the containers 130*a*-130*n*, they may be stacked at an angle on an inclined surface 140 of a base 142. The inclined surface has notches 142*a*-142*d* sized and shaped to receive respective ribs 134*a*-134*d*. In stacking the containers 130*a*-130*n* of FIG. 12, each successive container may be offset, for example, to the left as shown in FIG. 12, from a container below it to create a substantially vertical stack of containers 130*a*-130*n* on the inclined support surface 140. The interlocking of ribs 134*a*-134*d* on a container, for example, container 130*b*, with ribs 138*a*-138*d* on an adjacent lower container, for example, container 130*a*, inhibits container 130*b* from sliding downward with respect to the lower container 130*a* in an angular direction generally parallel to the inclined support surface 140. Thus, the interlocking of ribs on the respective containers 130*a*-130*n* provides a very stable, substantially vertical stack 143 on the inclined or tilted support surface 140. In a manner as previously described, the containers 130*a*-130*n* may be fluidly connected to external devices or with each other in a manner suitable to a particular application.

Figure 15:
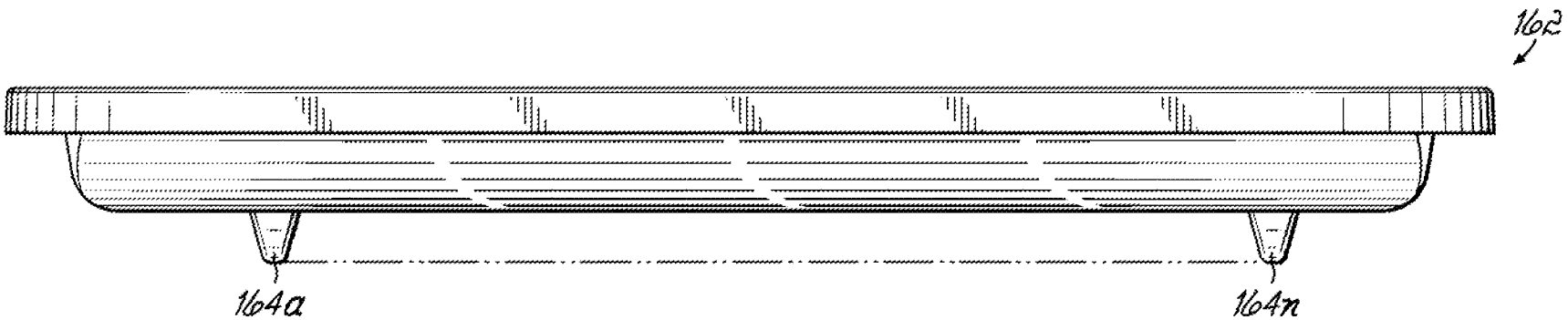
FIG. 15 is a side elevation view of an alternative embodiment of projections that may be used with a pan to form a container for supporting a flexible bag of liquid.

As noted above, in the vertical stack 139 of FIG. 11, the center lines of the ribs 138*a*-138*d* of pan 132*b* are located substantially midway between center lines of the ribs 134*a*-134*d* of the pan 132*a*. This relative orientation of the ribs may be achieved by several different embodiments. In a first embodiment, the pans 132*a*, 132*b* may be similar in structure to the pan 20 illustrated in FIG. 1. In this embodiment, the pans have an internal structure at one end 26 that is different from the internal structure at the other end 28. Hence the internal structure is nonsymmetrical from end to end with respect to a pan center point. In this embodiment, the pans 132*a*, 132*b* are molded as two different pieces to obtain the alignment of the ribs 138*a*-138*d* to the ribs 134*a*-134*d* as shown in FIG. 11. Further, if the pans 132*a*, 132*b* are separately molded as respective lower and upper container parts, their respective internal structures may also be different. In FIGS. 11 and 12, the ribs 134*a*-134*b*, 138*a*-138*b* have a particular cross-sectional profile and spacing. In alternative embodiments, the ribs may have any other suitable cross-sectional shape and spacing, for example as shown in FIG. 15, a pan 162 may have ribs 164*a*-164*n* that are narrower and closer together.

Figure 13:
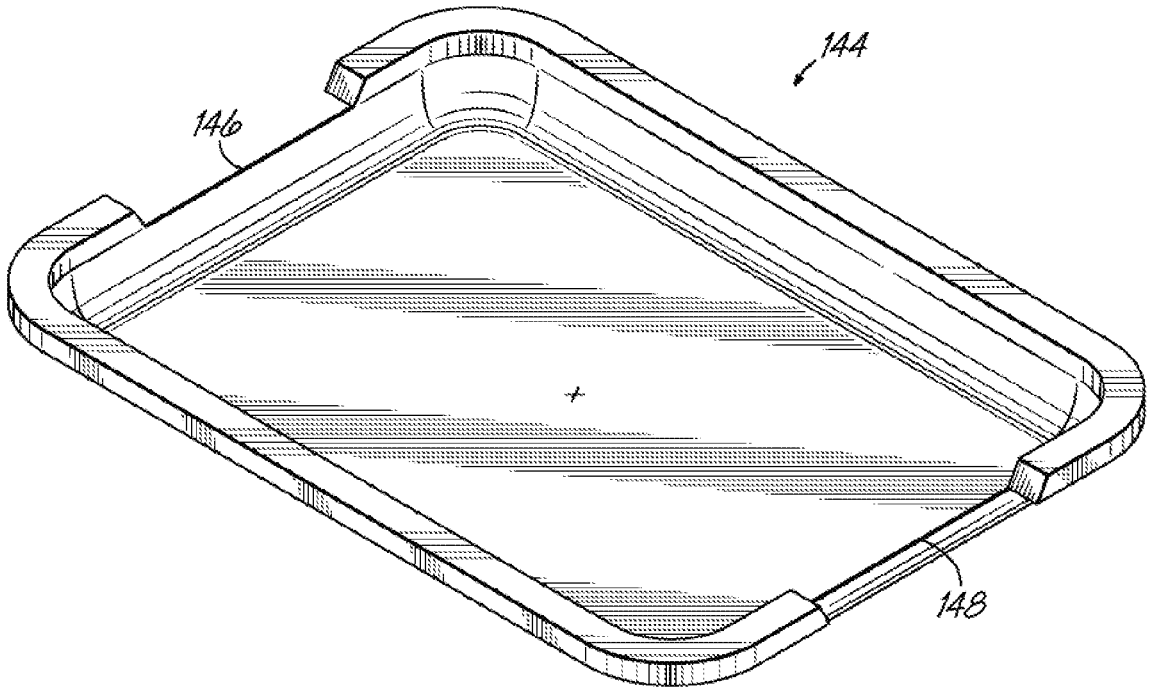
FIG. 13 is a perspective view of a further embodiment of a pan used to make a container for supporting a flexible bag of liquid.

In an alternative embodiment, the pans 132*a*-132*n* may have an internal structure similar to that of pan 144 shown in FIG. 13. With pan 144, an internal structure at one end 146 is generally similar to an internal structure at an opposite end 148. Thus, the pan 144 is symmetrical from end to end with respect to a pan center point. If the pan 144 of FIG. 13 is used as the pans 132*a*-132*b* of FIG. 12 to make the container 130*a*, the upper pan 132*b* is rotated about 180 degrees with respect to lower pan 132*a* to place center lines of the ribs 138*a*-138*d* substantially midway between center lines of the ribs 134*a*-134*d* of the pan 132*a*. A similar construction may be applied to the other containers 130*b*-130*n*.

Figure 14A:
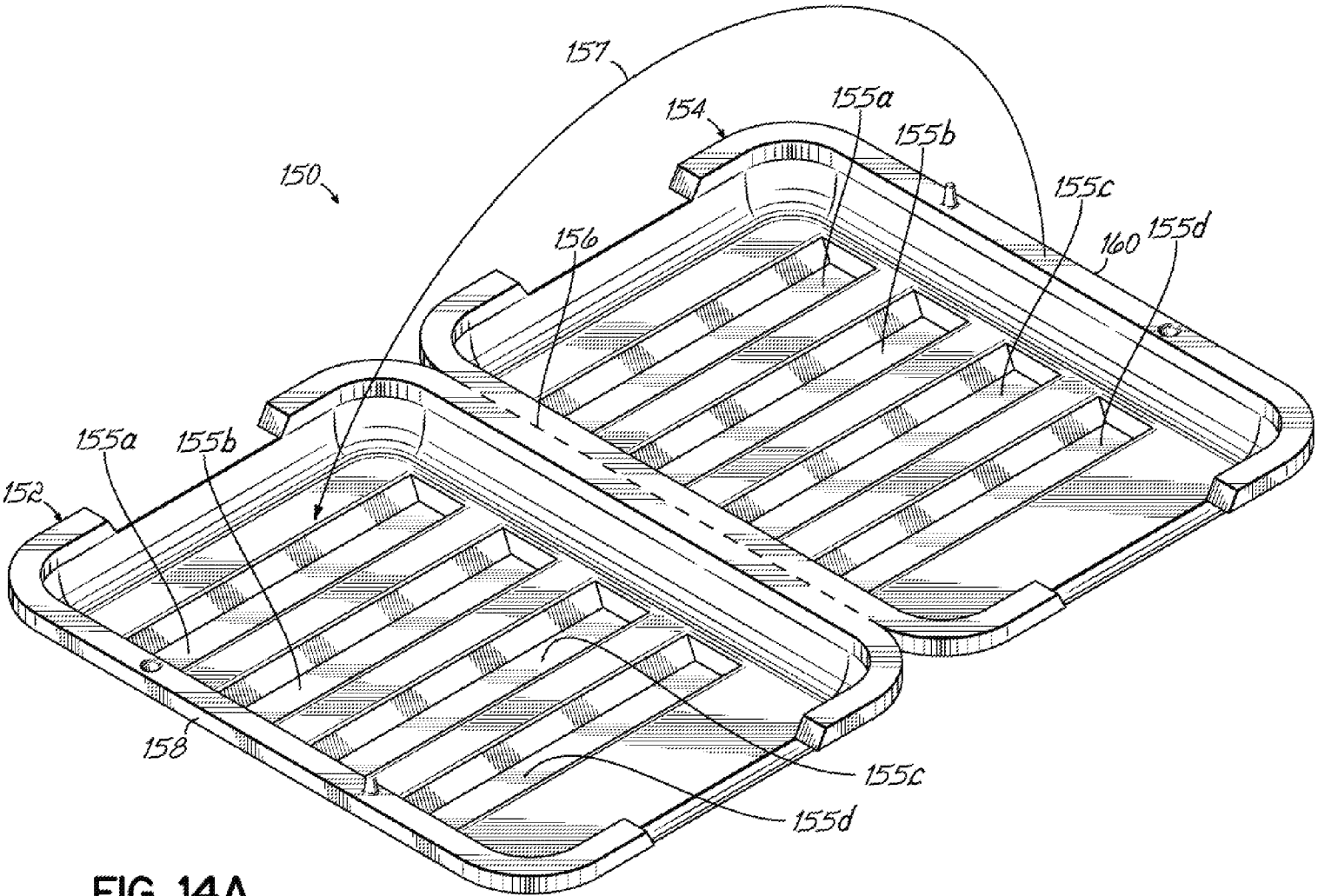
FIGS. 14A-14B are perspective views of a still further embodiment of a container for supporting a flexible bag of liquid.
Figure 14B:
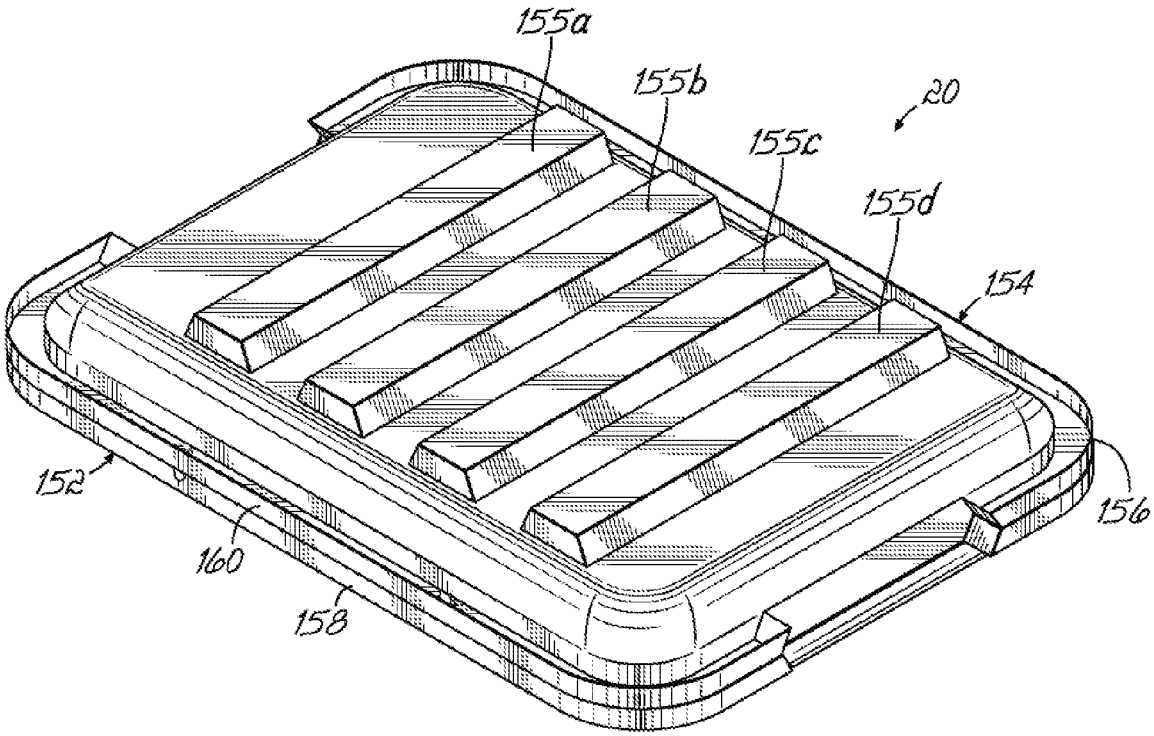

Referring to FIG. 14A, a container 150 may be comprised of two pans 152, 154 that are made as a single piece. The pans 152, 154 have respective ribs or projections 153*a*-153*d*, 155*a*-155*d* and are joined together along a common edge 156. In use, upon a flexible bag of liquid being placed in the pan 152, the opposing pan 154 may be folded approximately 180 degrees with respect to the common edge 156 as shown by the arrow 157. The pan 154 is then folded in opposition to the pan 152 to form the container 150 as shown in FIG. 14B. The opposed outer edges 158, 160 of the container 150 may be connected by a clamp, fastener, welding or other suitable connection.

Figure 16A:
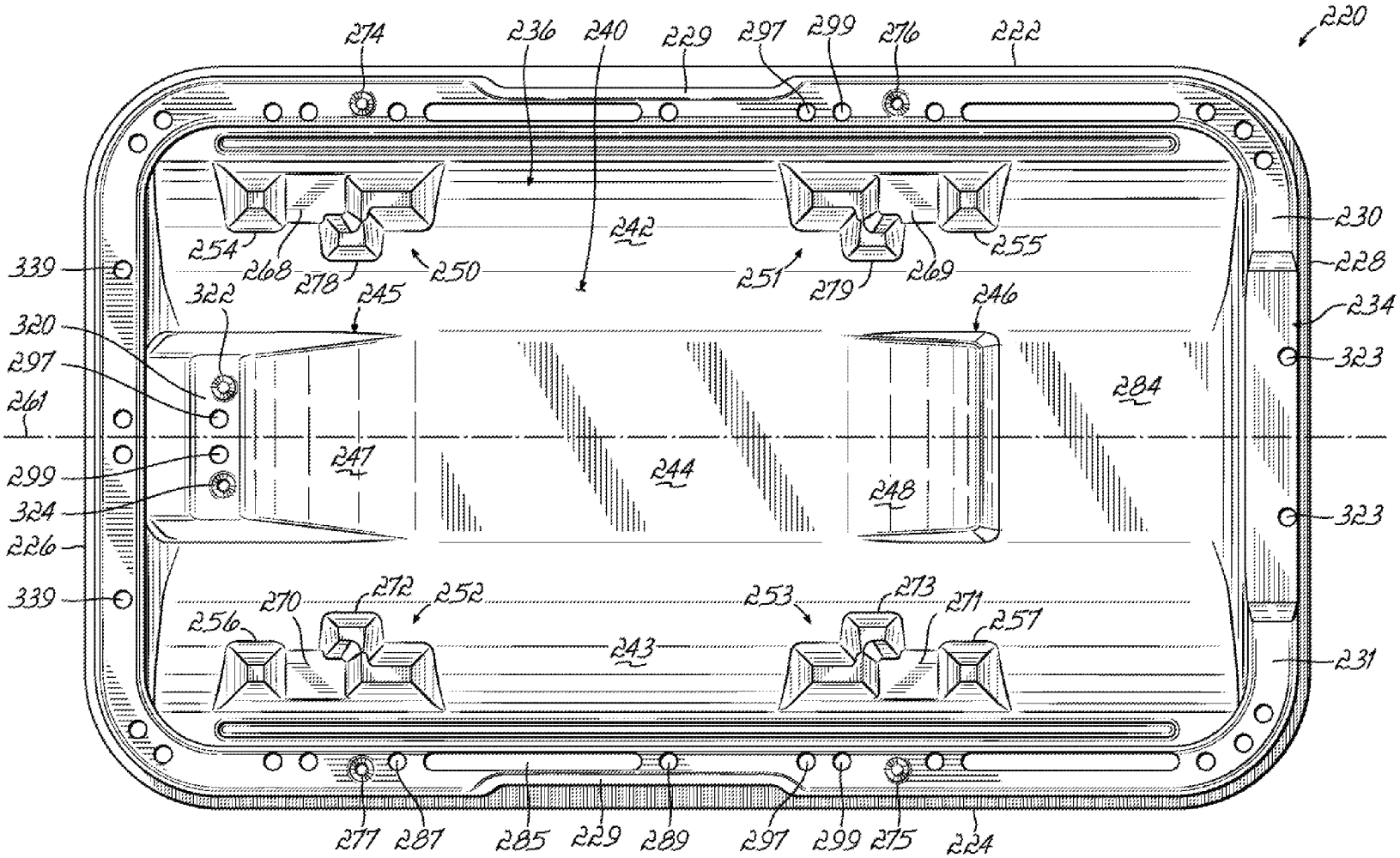
FIGS. 16A-16D are views of yet another exemplary embodiment of a pan that may be used to form a container for supporting a flexible bag of liquid.
Figure 16B:
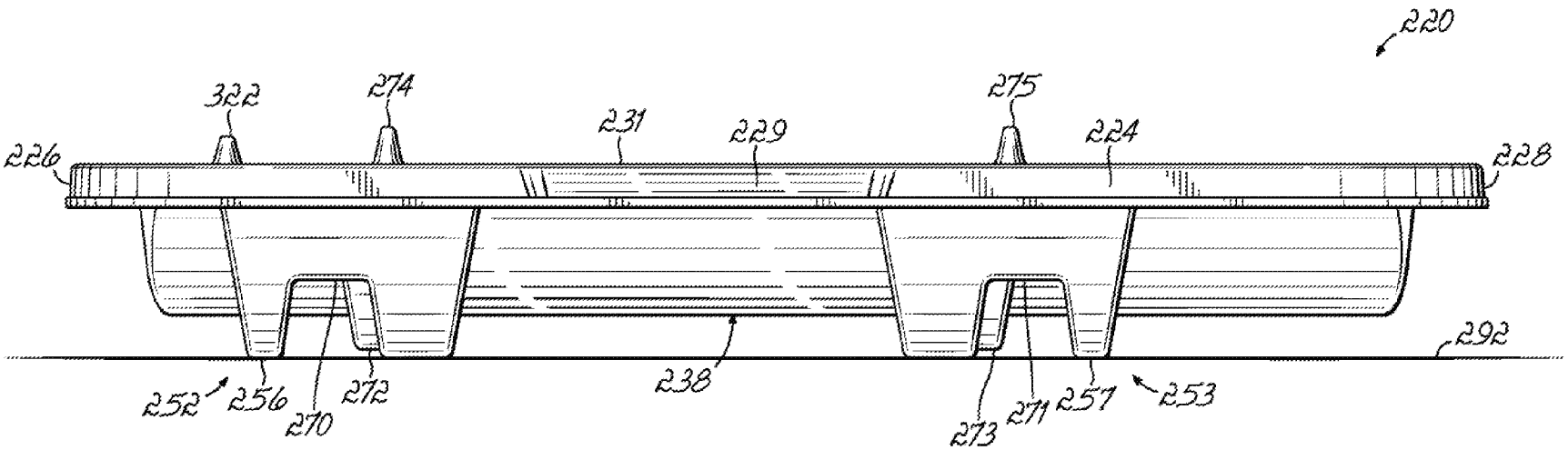
Figure 16C:
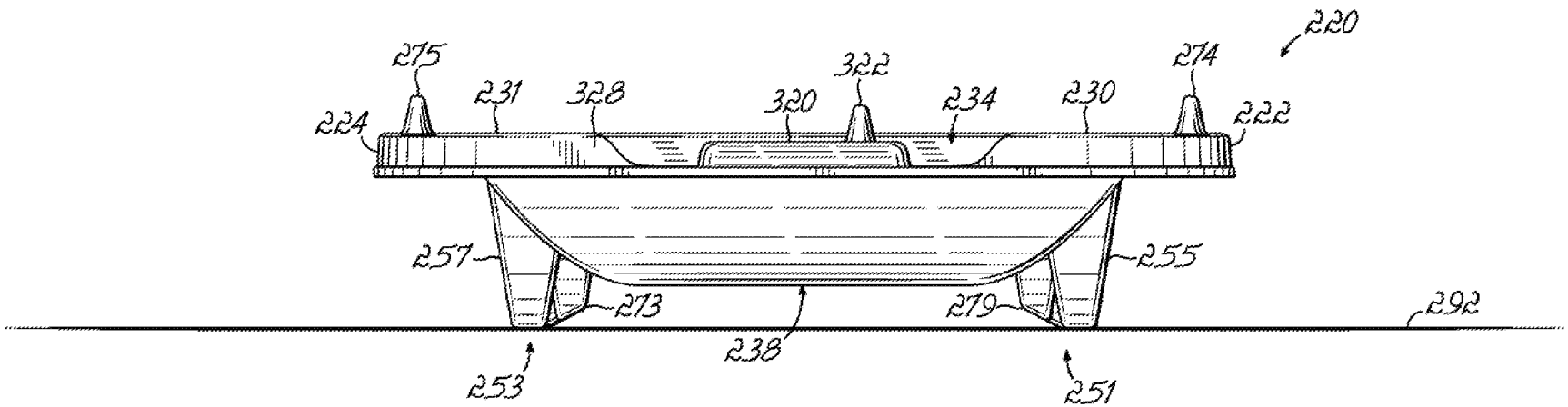

Referring to FIGS. 16A-16C, in another exemplary embodiment, a pan 220 is similar to the pan 20 of FIGS. 1-5 and has opposed lateral edges 222, 224 and opposed ends 226, 228. A space 234 is centrally located in the end 228 and interrupts opposed edge surfaces 230, 231. The edge surfaces 230, 231 are separated at the opposite end 226 by a longitudinal centerline 261 of the pan 220. Further, each of the edge surfaces 230, 231 has a recess or shoulder 229 located intermediate the ends 226, 228 and extending along a respective lateral edge 222, 224. The shoulders 229 increase the rigidity of the pan 220 along the lateral edges 222, 224. The pan 220 has an inner directed surface or side 236 and an opposed outer directed surface or side 238 (FIG. 16B). The inner directed side 236 has a cavity or depression 240 formed with respect to inner edge surfaces 230, 231. The depression 240 has lateral angular inner sloping side walls 242, 243, a portion of which intersect a generally flat, centrally located surface 244. End projections 245, 246 extend outward and away from the inner side 236 and are shaped to form angular and inward sloping end walls 247, 248, which are generally perpendicular to the angular side walls 242, 243 and also intersect the central surface 244. The angular side walls 242, 243, angular end walls 247, 248 and intermediate surface 244 are generally configured to conform to the sides and ends of a flexible bag filled with a liquid.

First multiple projections 250, 251 extend outward from the outer side 238 adjacent the lateral edge 222; and second multiple projections 252, 253 extend outward from the outer surface 238 adjacent the second lateral edge 224. The first multiple projections 250, 251 are generally identical in size and shape and provide respectively first legs 254, 255 with respective notches 268, 269 and respective other projections 278, 279. The second multiple projections 252, 253 are also generally identical in size and shape and provide respectively first legs 256, 257 with respective notches 270, 271 and respective other projections 272, 273.

The legs 254-257 are designed to contact a surface 292 onto which the pan 220 is placed; and those legs support the weight of the pan 220, a flexible bag filled with a liquid supported by the pan as well as other structure that may be stacked on top of the pan 220.

In this exemplary embodiment, the other projections 278, 279, 272, 273 are intended principally to prevent lateral horizontal movement of one pan with respect to another pan when the pans are in a stacked configuration in a manner similar to the function of projections 72*c* and 73*c* shown and described with respect to FIG. 7A. While the other projections 278, 279, 272, 273 may be similar in length to the other leg projections, the other leg projections 278, 279, 272, 273 may not be configured to provide significant load bearing function.

A first projection or pin 274 extends outward from the peripheral surface 230 along the lateral side 222, and a projection or second pin 275 extends outward from the peripheral surface 231 along the lateral side 224. A first depression, socket or hole 276 extends downward from the peripheral surface 230 along the lateral side 222, and a second depression, socket or hole 277 extends downward from the peripheral surface 231 along the lateral side 224.

Lateral edge 224 has an elongated opening or slot 285 and associated holes 287, 289 adjacent opposed ends of the slot 285 for receiving a handle to be subsequently described. The pattern of the slot 285 and associated holes 287, 289 is repeated at different locations along the lateral edges 222, 224. Pairs of fastener holes 297, 299 are also located on the lateral edges 222, 224 for receiving one or more fasteners to be subsequently described. In the embodiment of FIG. 16A, there are four sets of slots 285 and associated holes 287, 289 for handles and nine pairs of fastener holes 297, 299 extending along the lateral edges 222, 224. There is also an additional pair of fastener holes 297, 299 on the surface 320. However, in other embodiments, other numbers of handle slots and fastener hole pairs may be used.

In a manner similar to that previously described with respect to FIG. 6, a flexible bag or bladder of liquid (not shown) is located in cavity 240 of the pan 220 of FIG. 16. A projection or pin 322 extends outward from a surface 320 on the end projection 245; and a depression, socket or hole 324 extends downward from the surface 320. In a manner similar to that previously described with respect to FIG. 8A, when the flexible bag of liquid is placed in the pan 220, an opening in an end of the bag is placed around the pin 322 and hole 324. Referring to FIG. 16A, a flexible bag of liquid (not shown) may be located in a first pan 220*a* with a bag handle end placed on surface 320 and around pin 322 and socket 324. As shown in FIG. 16D, a second pan 220*b* is placed over the first pan 220*a*. The pans 220*a*, 220*b* are then brought together such that pins of pan 220*a* are inserted into holes of pan 220*b* and vice versa. The pans 220*a*, 220*b* are further moved together until opposed edge surfaces of pan 220*a* contact respective edge surfaces of pan 220*b*. When finally positioned in the juxtaposed relationship shown in FIG. 16D, the two opposed pans 220*a*, 220*b* form a container 282 for a flexible bag of liquid contained therein.

Figure 17:
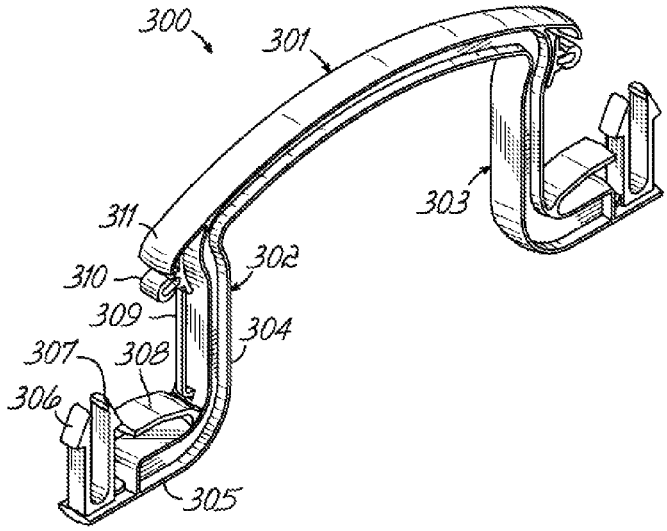
FIGS. 17-17B are views of an exemplary embodiment of a handle that may be used with a container formed from the pan of FIGS. 16-16A for supporting a flexible bag of liquid.

A handle may now be provided to facilitate handling the container 282. Referring to FIG. 17, a generally U-shaped handle 300 has a grip portion 301 connected at its ends to two generally L-shaped sides 302, 303. The sides 302, 303 are substantially similar; and therefore, only side 302 will be described in detail. A first, upper link 304 extends in a generally perpendicular direction from an end of the grip portion 301. A second, lower link 305 is connected at a proximal end of, and extends generally perpendicular from, a lower end of the first link 304. A pair of opposed hooks 306, 307 are mounted on a distal end of the second link 305 and extend upward toward the grip portion 301. The hooks 306, 307 extend generally perpendicular to the second link 305 and parallel with the first link 304. A resilient member 308 is connected at a proximal end to the L-shaped side 302 and has a distal end extending outward toward the hook 307. A resilient tether 309 has a proximal end connected to the side 302 and a distal end connected to a lock plug 310. In its unused position, the lock plug 310 is located below a shield member 311 extending from an end of the grip 301.

Figure 16D:
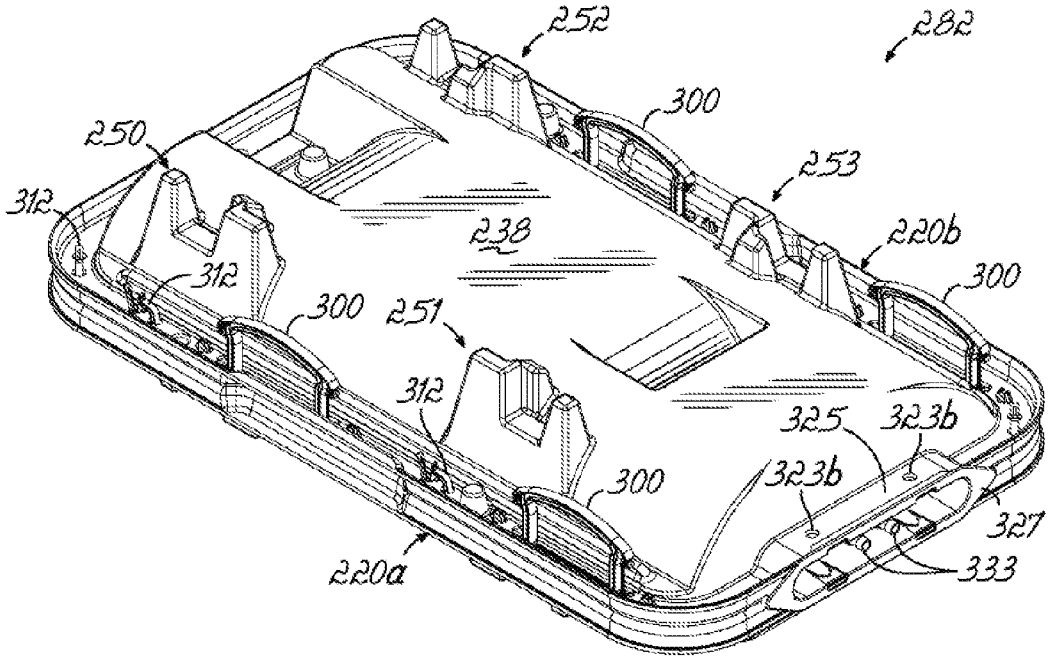
Figure 17A:
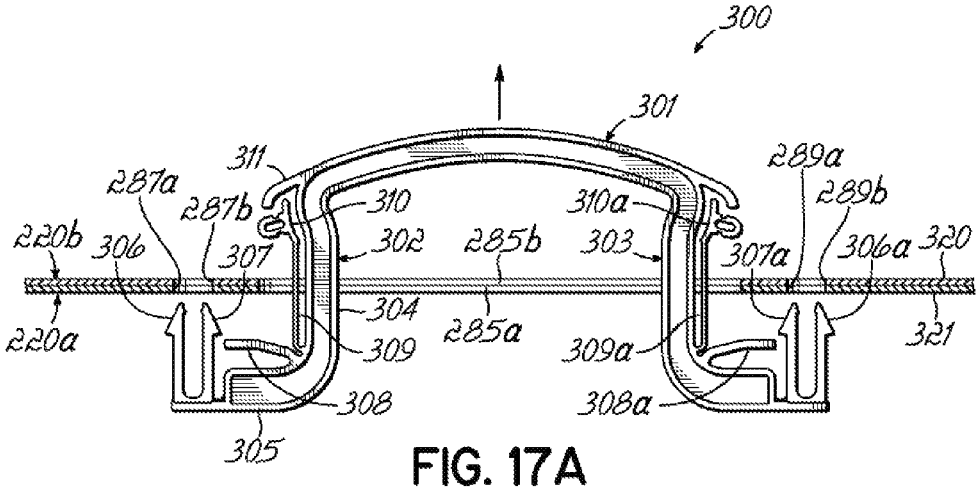
Figure 17B:
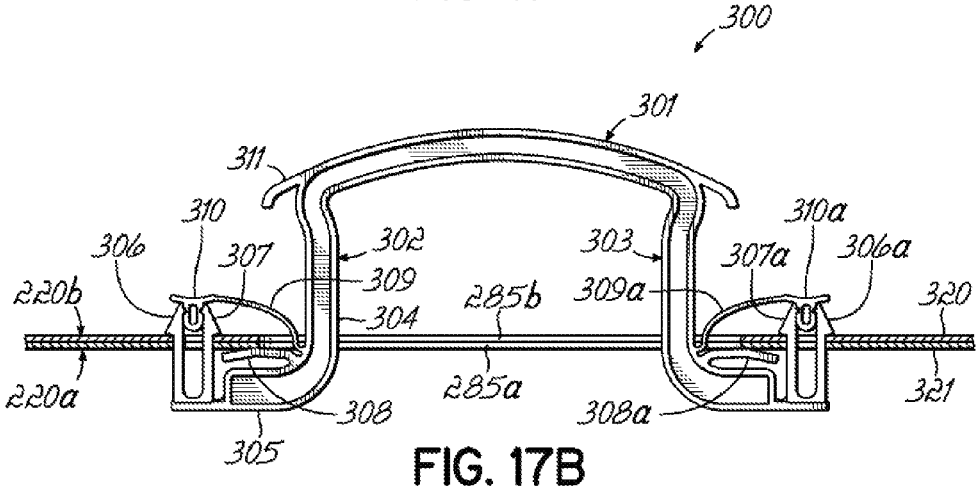

Referring to FIG. 17A, the grip portion 301 is inserted through slots 285*a*, 285*b*; and hooks 306, 307 are directed through the holes 287*a*, 287*b*. Hooks 306*a*, 307*a* are directed through holes 289*a*, 289*b*. The handle 300 is pulled upward as shown in FIG. 17A until the distal ends of the hooks 306, 307 and 306*a* 307*a* clear the respective holes 287*b* and 289*b*. As shown in FIG. 17B, the resilient members 308, 308*a* are deflected and apply a force against the bottom side 321 of pan 220*a*. The hooks 306, 307, 306*a*, 307*a* react the forces applied by the resilient members 308, 308*a*, thereby helping to hold the pans 220*a*, 220*b* together. Lock plugs 310, 310*a* on the distal ends of respective resilient tethers 309, 309*a* are then inserted between respective hook pairs 306, 307 and 306*a*, 307*a*, thereby securing the handle 300 in place. In some applications, upon removing the lock plugs 310, 310*a*, the distal ends of the hooks 306, 307, 306*a*, 307*a* may be pressed together; and the handle 300 removed from the slots 285*a*, 285*b*. When fully assembled, the hooks 306, 307, 306*a*, 307*a* and lock plugs 310, 310*a* are effective to secure the pans 220*a*, 220*b* together. Further, as shown in FIG. 16D, using four handles 300 secures the pans 220*a*, 220*b* together proximate the pan corners and thus, provides a unitary container 282 for the bag of liquid as well as lifting points on each side.

Figure 18:
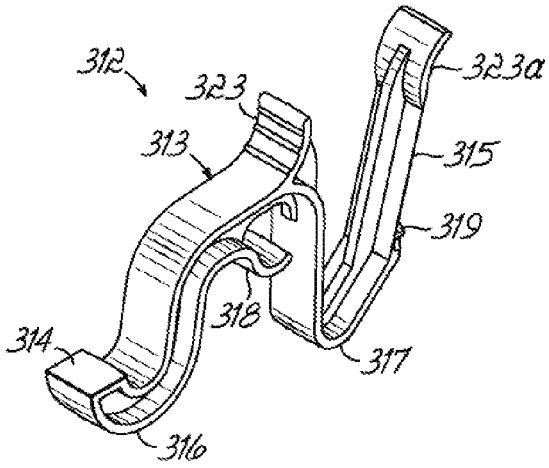
FIGS. 18-18B are views of an exemplary embodiment of a clip that may be used with a container formed from the pan of FIGS. 16-16A for supporting a flexible bag of liquid.
Figure 18A:
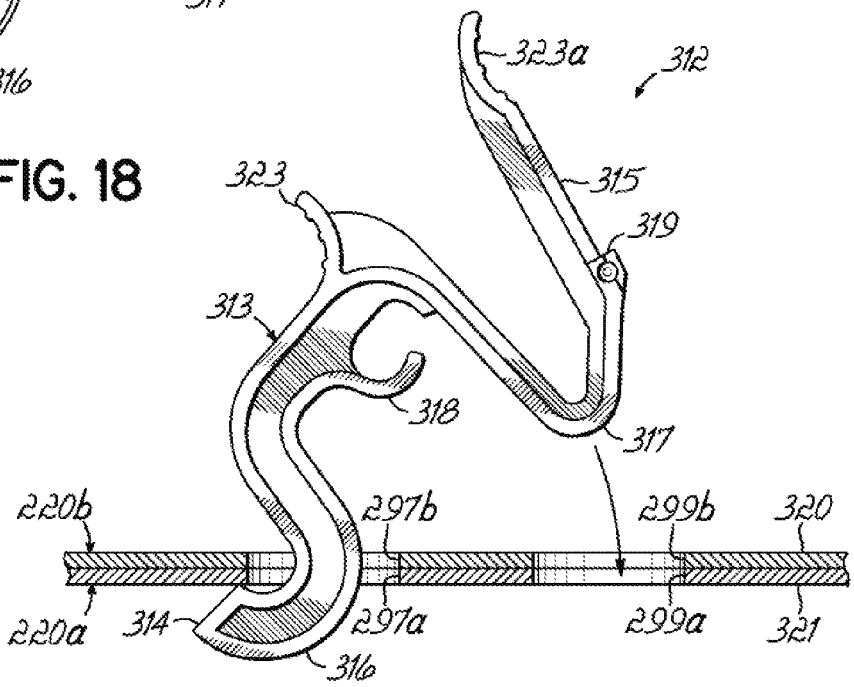
Figure 18B:
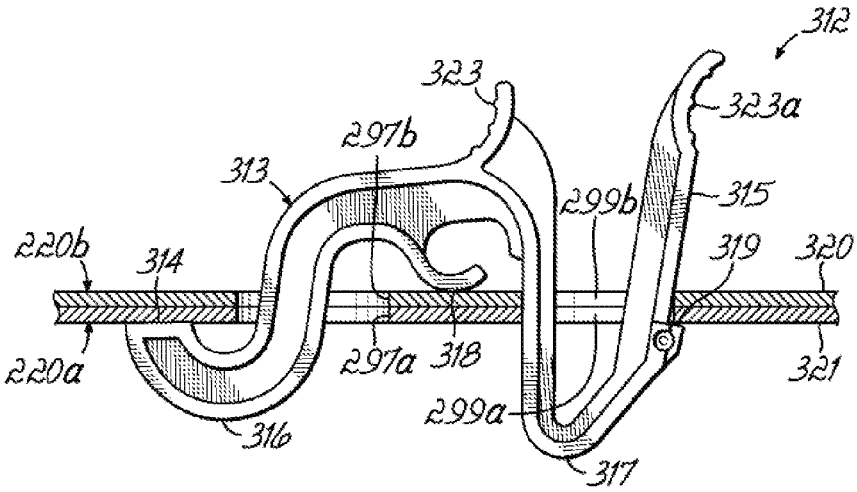

In some applications, it may be desirable to provide one or more additional connectors to further fasten the pans 220*a*, 220*b* together. Referring to FIG. 18, a connector or clip 312 has a generally S-shaped body 313 with a bearing surface 314 on one end and a resilient arm 315 connected at an opposite end. Referring to FIG. 18A, a first end 316 of the clip 312 is inserted in holes 297*a*, 297*b* of respective pans 220*a*, 220*b* that have brought together to form a container. The clip 312 is rotated clockwise as viewed in FIG. 18A, and a looped end 317 is directed into the holes 299*a*, 299*b*. As shown in FIG. 18B, further clockwise rotation of the clip 312 locates the bearing surface 314 against a lower surface 321 of the pan 220*a* and brings a resilient member 318 into contact with an upper surface 320 of the pan 220*b*. The clip 312 is pushed further downward as viewed in FIG. 18B thus deflecting resilient member 318 until a locking surface 319 passes through the hole 299*a* and bears against the lower surface 321, thereby securing the clip in place and holding the pans 220*a*, 220*b* together. When bearing against the lower surface 321, the locking surface 319 prevents the clip 312 from inadvertently being removed and reacts a force being applied by the member 318 to hold the pans 220*a*, and 220*b* together. To remove the clip 312, finger grips 323, 323*a* are pressed together to release locking surface 319 from the surface 321 and permit the locking surface 319 to pass upward through the holes 299*a*, 299*b*. Any number of clips 312 may be used with the pairs of fastener holes 297, 299.

In the exemplary example of FIG. 18, the clip 312 is principally intended for use with containers that are reusable; however, in other embodiments, other connectors may be used to releasably connect pans 220*a*, 220*b* together using holes 297, 299, for example, a push/pull plastic captive fastener commercially available as McMaster-Carr Part No. # 93040A103, a NYLON reusable snap-lock rivet commercially available as McMaster-Carr Part No. #91020A220, NYLON cable ties, threaded fasteners, or other suitable connectors. However, if the container 282 formed by the pans 220*a*, 220*b* is intended to be disposable, then the pans may be joined by welding, adhesives, or other connectors using the holes 297, 299, for example, a DELRIN blind rivet commercially available as McMaster-Carr Part No. # 90219A325, a NYLON blind rivet commercially available as McMaster-Carr Part No. # 90219A044, an aluminum or steel rivet or other suitable connectors. Clips 312 or fasteners may be inserted through holes 297, 299 on surface 320 of FIG. 16A to secure the pans 220*a*, 220*b* together directly at the handle end of the bag of liquid.

Figure 19:
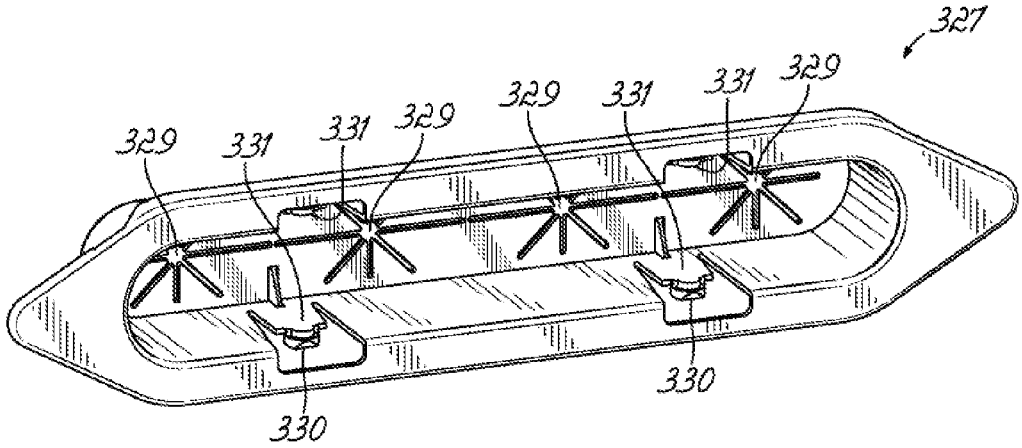
FIG. 19 is a perspective view of an exemplary embodiment of a faceplate that may be used with a container to support tubing connected to a flexible bag of liquid.

As noted earlier, the flexible bags of liquid have multiple ports and respective tubing extending from one end. Often the tubing is in a package; and in some applications that package is simply located in a forward end cavity 284 shown in FIG. 16A during shipment of the container 282 of FIG. 16D. In other applications, the ends of tubing from the flexible bag of liquid may be secured for shipping and use. As shown in FIG. 16A, the pan 220 has a recessed space 234 generally centrally located on the end 228, and two holes 323 are located on an edge surface within the opening 234. As shown in FIG. 16D, the opposed openings of pans 220*a*, 220*b* form an elongated opening 325 at one end of the container 282, and ends 333 of tubing connected to the flexible bag may be directed through the opening 325. Referring to FIG. 19, a faceplate 327 has a plurality of openings 329 formed by one or more slits that form a star, X, plus sign or other shape appropriate for securing the tubing in a respective opening. One or more ends of tubing are inserted through respective holes 329 in the faceplate 327. In some applications, the tubing may be shorter and only long enough to just extend through the holes 329. In other applications, the tubing may be longer; and that tubing may then be coiled back into a storage space formed by a forward end cavity 284 shown in FIG. 16A. Referring to FIG. 19, the faceplate 327 has upper and lower outward facing projections 330 mounted on distal ends of resilient members 331; and referring back to FIG. 16D, as the faceplate 327 is slid into the opening 325, the projections 330 (FIG. 19) engage respective holes, for example, holes 323*b* (FIG. 16D), thereby locking the faceplate 327 in the opening 325. Thus, the ends of the tubing are securely supported at the end of the container 282 during handling and shipping. During use, a desired length of tubing may be pulled from a respective hole of the faceplate 327.

Figure 20A:
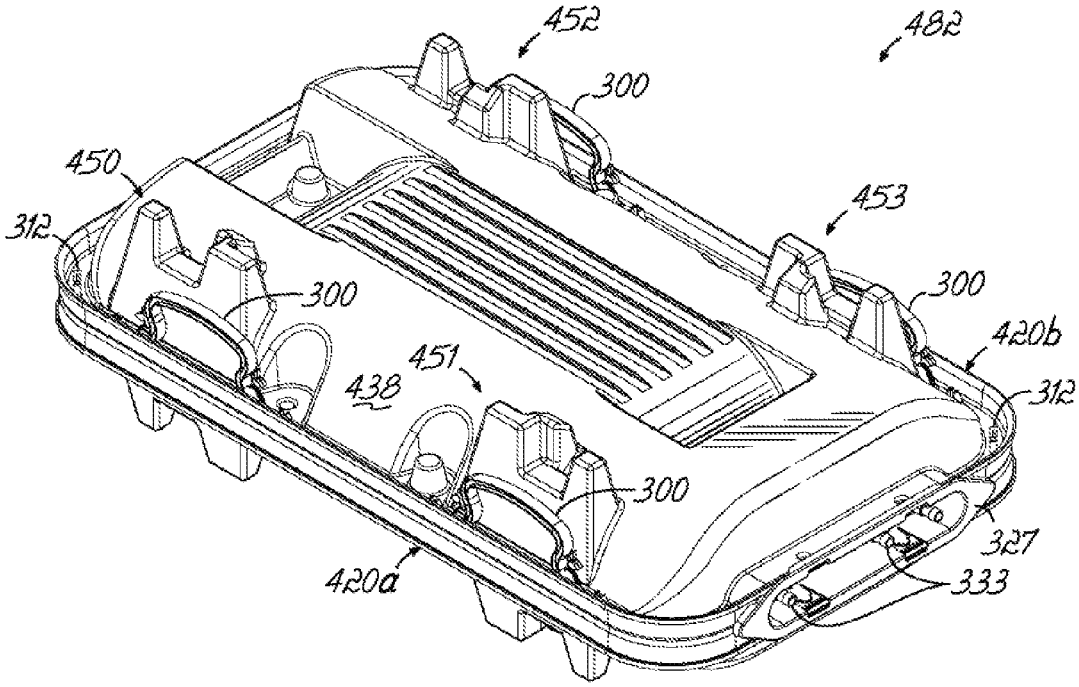
FIGS. 20-20A are views of one more exemplary embodiment of a pan that may be used to form a container for supporting a flexible bag of liquid.
Figure 20:
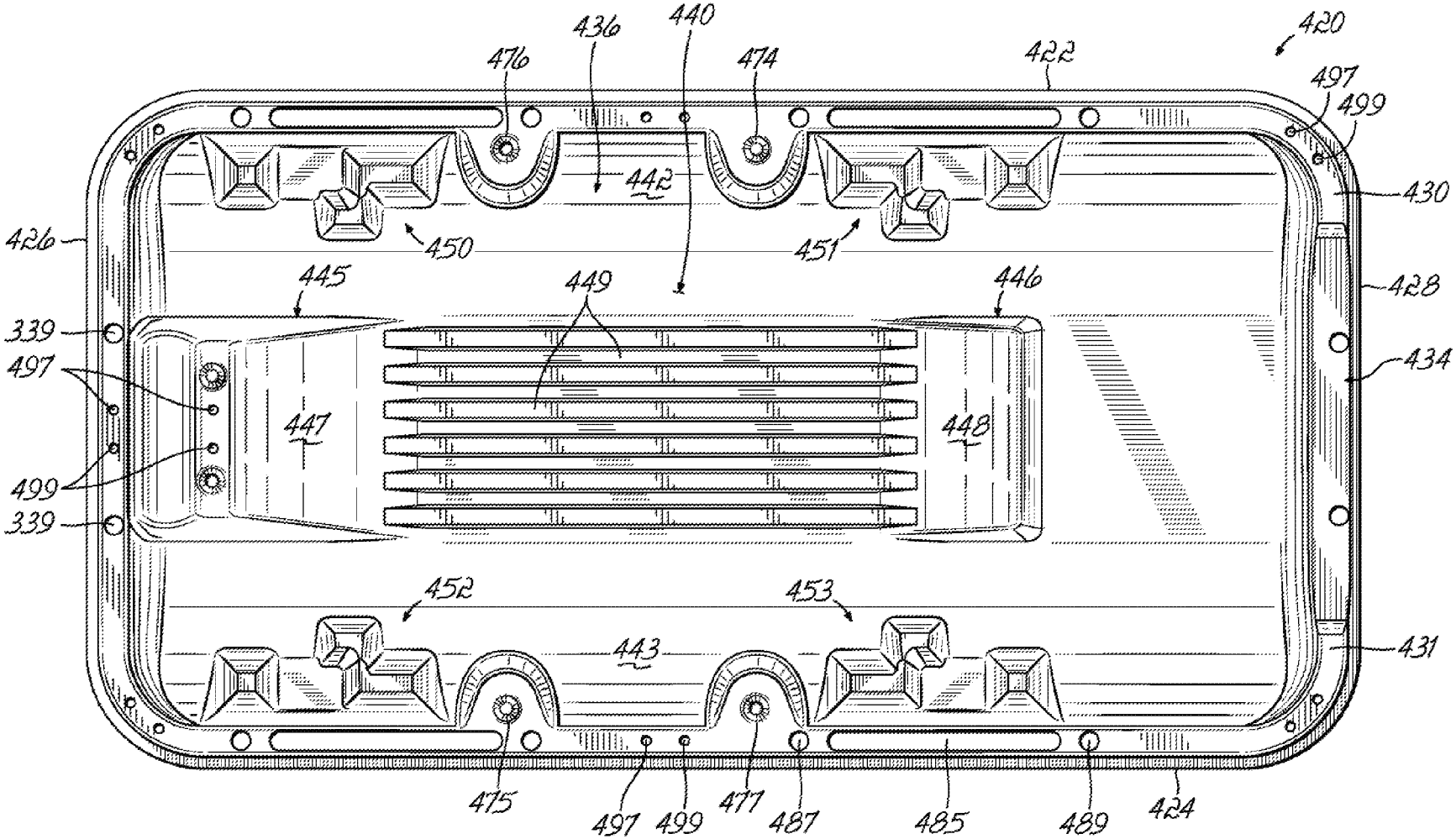

Referring to FIG. 20, in another exemplary embodiment, a pan 420 is similar to the pan 220 of FIGS. 16A-16C and has opposed lateral edges 422, 424 and opposed ends 426, 428. A space 434 is centrally located in the end 428 and interrupts opposed edge surfaces 430, 431. The opposed edge surfaces 430, 431 are narrower than their counterpart edge surfaces 230, 231 on pan 220 shown in FIG. 16A; and thus, the opposed edge surfaces do not have the shoulder 229 of pan 220. However, the narrower edge surfaces 430, 431 also improve the rigidity of the lateral edges. The pan 420 has an inner directed surface or side 436 with a cavity or depression 440 formed with respect to the edge surfaces 430, 431. The depression 440 has lateral angular inner sloping side walls 442, 443, a portion of which intersect an area containing a plurality of ribs 449 that are generally centrally located between the lateral edges 422, 424. End projections 445, 446 are generally similar to the end projections 245, 246 of FIG. 16 and extend outward and away from the inner side 436 with angular and inward sloping end walls 447, 448. The ribs 449 extend generally lengthwise with respect to the pan 420 and intersect the sloping end walls 447, 448. The ribs 449 substantially improve the rigidity of the pan 420 between the sloping end walls 447, 448 as compared to the flat surface 244 of the pan 220 of FIG. 16.

The pan 420 has multiple projections 450, 451, 452, 453 that are substantially similar in construction, location and function to respective multiple projections 250, 251, 252, 253 of the pan 220 shown in FIGS. 16A-16D. The pan 420 further has pins 474, 475 sockets 476, 477 slots 485, associated holes 487, 489 and fastener holes 497, 499 that are substantially similar in construction and function to respective pins 274, 275 sockets 276, 277 slots 285, associated holes 287, 289 and fastener holes 297, 299 of pan 220 of FIG. 16A. The pan 420 further has a space 434 that is substantially similar to the space 234 of FIG. 16A and used to receive a faceplate as shown in FIG. 19 for supporting tubing ends as previously described with respect to pan 220 of FIG. 16D.

In a manner similar to that previously described with respect to FIGS. 6 and 16D, as shown in FIG. 20A, a flexible bag or bladder of liquid (not shown) is generally centrally located in a cavity of a first pan 420*a*. Thereafter, a second pan 420*b* is placed over the first pan 420*a* and assembled therewith with handles and/or connectors or clips in a manner similar to that described with respect to FIGS. 16-18 to form a container 482 for supporting a flexible bag of liquid therein. As previously described a faceplate 327 is used to support ends 333 of tubing connected to the flexible bag of liquid within the container 482.

Figure 21:
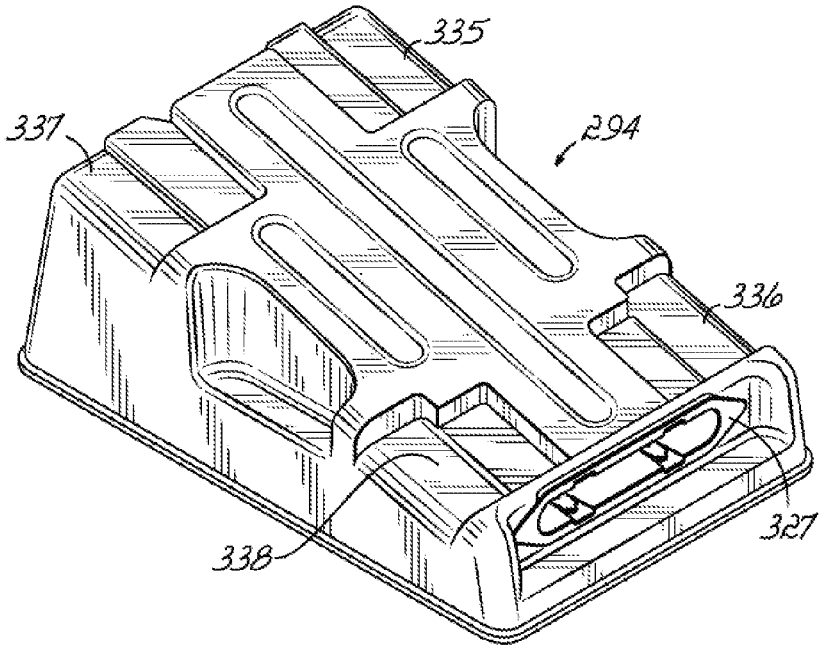
FIG. 21 is a perspective view of an exemplary embodiment of a base that may be used to support a container for supporting a flexible bag of liquid.

In a manner similar to that described with respect to FIGS. 7A and 7B, the containers 282 and/or 482 may be stacked with similar containers on a generally horizontal surface. Further, in a manner similar to that described with respect to FIG. 8, the containers 282 and/or 482 may be stacked with similar containers on a sloped surface using an angled base 294 shown in FIG. 21. In a further manner similar to that described with respect to FIG. 8, the containers 282 (FIG. 16D) and 482 (FIG. 20A) may be stacked in a continuous offset stacking arrangement on the angled base 294. The angled base 294 has recesses 335, 336, 337, 338 at its corners that are sized and shaped to receive legs of a container 282 or 482. The recesses 335, 336, 337, 338 are effective to prevent the container 282 or 482 from sliding either laterally, or downward, off the angled base 294. The angled base 294 is also fitted with a faceplate 327 that permits tubing to run into and out of the interior of the base 294. In some embodiments, the angled base 294 may support, within its interior, components for controlling a flow of liquid, for example, one or more valves, a peristaltic pump, filters and/or other components. Thus, tubing may extend from a faceplate on a container, into faceplate 327 on the angled base 294, through a component in the base 294, out of faceplate 327 on the base 294 and to an external component determined by a user.

In the exemplary embodiments of the various pans 20, 132, 144, 152, 154, 162, 220, 420 shown and described herein, the size, construction material, and thickness may be easily be varied to accommodate a wide range of sizes of flexible bags of liquids. For example, in some embodiments, different pans may be made to accommodate bags of liquid of 5, 10, 20, 50, 100, 200 or 500 liters. In other embodiments, pans of other sizes may be made. Thus, respective containers formed from the various pans 20, 132, 144, 152, 154, 162, 220, 420 may have a desired size, durability and rigidity for a wide range of applications and sizes of flexible bags of liquid. For example, referring to FIG. 6, the volume 83 of the container 82*a* is slightly larger than the volume of the bag 80. Such a larger volume provides space for the bag 80 to expand within the container 82*a* upon freezing the container 82*a* and bag 80.

In other embodiments, the various pans 20, 132, 144, 152, 154, 162, 220, 420 may be made of materials that are suitable for use in sterile and "clean" environments; and in still further embodiments, the various pans 20, 132, 144, 152, 154, 162 may be made to be disposable or reusable. Thus, the pans 20, 132, 144, 152, 154, 162, 220, 420 may be made from a wide variety of materials, for example, polycarbonate, PETG, HDPE, ABS, PVC, polypropylene or other materials. In still further applications, the various pans 20, 132, 144, 152, 154, 162, 220, 420 may be made of metal, rigid foam or other material. Thus, the various pans 20, 132, 144, 152, 154, 162, 220, 420 may be made from transparent, translucent or opaque materials.

In the exemplary embodiments of the various pans 20, 132, 144, 152, 154, 162, 220, 420 shown and described herein, containers may be made from the pans, which have respective cross-sectional thicknesses 93*a*, 93*b* (FIG. 6) that are generally constant across generally the entirety of the respective pans. Depending on the material used, in different embodiments, the cross-sectional thickness may range from about 0.050 to 0.500 of an inch. In other embodiments, the cross-sectional thickness may be more or less. The exemplary embodiments of the various pans 20, 132, 144, 152, 154, 162, 220, 420 may be made using any molding or forming process that is suitable to the material being used. In some embodiments, the various pans 20, 132, 144, 152, 154, 162, 220, 420 may be vacuum-formed from a relatively thin, flexible sheet material, for example, a thermoplastic or other suitable material. In different embodiments, the various pans 20, 132, 144, 152, 154, 162, 220, 420 may be flexible, that is, if they are held at opposite ends 26, 28 or 226, 228, the opposite ends may be easily manually rotated or twisted in opposite directions. Further, flexible means that the lateral edges 22, 24, 222, 224 may be easily manually curled or deformed. Alternatively, in other embodiments, the various pans 20, 132, 144, 152, 154, 162, 220, 420 may be made by injection molding or another suitable plastics forming process.

While the invention has been set forth by a description of the preferred embodiment in considerable detail, it is not intended to restrict or in any way limit the claims to such detail. Additional advantages and modifications will readily appear to those who are skilled in the art. For example, as described herein, containers 82, 130, 282, 482 may be stacked in a generally vertical orientation on an inclined surface. The containers are stacked manually and thus, the verticality of any stack may vary substantially. Further, a center of gravity of a container stacked on an inclined surface will depend on, and vary with, the volume of liquid in the container. Thus, in some applications, one container may be generally horizontally offset from the other containers but still maintain a generally vertical orientation above the inclined surface. The projections on the various embodiments of pans described herein permit the relative positions of the stacked containers to be varied in order to obtain a desired stability by the person stacking the containers.

The numerous projections and ribs on the various pans 20, 132, 144, 152, 154, 162, 220, 420 may be varied in different embodiments to provide a pan rigidity sufficient to support a flexible bag of liquid. Further, the thickness of the various pans 20, 132, 144, 152, 154, 162, 220, 420 may be scaled and changed in proportion to the size of the flexible bag of liquid to be supported thereby. In still further embodiments, different projections and contours may be added and cross-sectional pan thicknesses varied in different areas of the various pans 20, 132, 144, 152, 154, 162, 220, 420 to enhance rigidity. However, any such changes in shape and thickness should be done so as not to diminish the stacking capabilities of the various pans 20, 132, 144, 152, 154, 162, 220, 420 as described herein.

In the embodiment of FIGS. 1-4, notches 68, 69, 70, 71 are generally J-shaped; and in the embodiment of FIGS. 16A-16D, the notches 268, 269, 270, 271 are generally U-shaped. In other embodiments, the notches may have other shapes that are effective to provide the described alignment and stability functions. Such other shapes are, for example, a generally L-shape, a generally V-shape, a stepped shape and other comparable shapes.

In the embodiments described herein, a pans 20, 132, 144, 152, 154, 162, 220, 420 are shown and described has having generally rectangular shapes. However, such rectangular shapes are exemplary in nature; and the pans 20, 132, 144, 152, 154, 162, 220, 420 may be of any shape that generally conforms to a shape of a bag of fluid to be supported by the pan, for example, rectangular, square, circular, oval or other shape. Further, in the embodiments described herein, the pans 20, 132, 144, 152, 154, 162, 220, 420 are illustrated as be supported on a surface, for example, a horizontal or inclined surface. In other embodiments, holes 339 of FIGS. 16A and 20 may be used to hang the containers in a vertical orientation.

Therefore, the invention in its broadest aspects is not limited to the specific detail shown and described. Consequently, departures may be made from the details described herein without departing from the spirit and scope of the claims which follow.

What is claimed is:

1. An apparatus usable to form substantially identical lower and upper parts of a container for a flexible bag of liquid, the apparatus comprising:

an inner surface configured to support the flexible bag of liquid when the apparatus is used as a lower part, the inner surface including side walls extending parallel to a longitudinal centerline of the inner surface and configured to support the flexible bag of liquid, and first and second contoured end projections extending directly upwardly from the inner surface and generally perpendicular to the longitudinal centerline of the inner surface, the first and second contoured end projections confronting each other along the longitudinal centerline of the inner surface and being configured to support opposite ends of the flexible bag with each of the first and second contoured end projections being spaced inwardly from the respective side walls;

an outer surface; and projections extending outward from the outer surface and adapted to support the apparatus on a support surface when the apparatus is used as a lower part of a first container, and when the apparatus is used as an upper part of the first container, the projections face away from the support surface and facilitate alignment with a second container in a stacked formation on the support surface, the projections on the first container adapted to extend between projections on the second container to provide a more stable stacked formation.

2. The apparatus of claim 1 wherein the projections on the first container are adapted to prevent the second container from sliding with respect to the first container in a first direction.

3. The apparatus of claim 1 wherein the projections comprise a plurality of substantially parallel ribs.

4. The apparatus of claim 1 wherein the projections comprise:

legs extending outward from the outer surface and adapted to support the apparatus on a support surface when the apparatus used as a lower part; and notches associated with respective ones of the legs, the notches adapted to face the support surface when the apparatus is used as a lower part, and the notches adapted to face away from the support surface and facilitate alignment of the second container in the stacked formation when the apparatus is used as an upper part.

5. The apparatus of claim 2 further comprising other projections extending outward from the outer surface, and when the apparatus is used as an upper part of the first container, the other projections face away from the support surface and facilitate alignment with the second container in the stacked formation on the support surface, the other projections adapted to prevent the second container from sliding with respect to the first container in a second direction substantially perpendicular to the first direction.

6. The apparatus of claim 1 wherein the support surface comprises a generally horizontal surface and the second container being generally horizontally offset from the first container in the stacked formation.

7. The apparatus of claim 1 wherein the support surface comprises an inclined surface and the projections are adapted to prevent the second container from sliding downward with respect to the first container in an angular direction generally parallel to the inclined surface.

8. The apparatus of claim 7 wherein the projections permit the second container to be stacked generally vertically on the first container being supported on the inclined surface.

9. The apparatus of claim 1 comprising a flexible part formed from a flexible sheet material.

10. An apparatus usable to form substantially identical lower and upper parts of a container for a flexible bag of liquid, the apparatus comprising:

an inner surface configured to support the flexible bag of liquid when the apparatus is used as a lower part, the inner surface including side walls extending parallel to a longitudinal centerline of the inner surface and configured to support the flexible bag of liquid, and first and second contoured end projections extending directly upwardly from the inner surface and generally perpendicular to the longitudinal centerline of the inner surface, the first and second contoured end projections confronting each other along the longitudinal centerline of the inner surface and being configured to support opposite ends of the flexible bag with each of the first and second contoured end projections being spaced inwardly from the respective side walls;

an outer surface;

opposed first and second lateral edges;

a first pair of spaced-apart legs adjacent the first lateral edge and a second pair of spaced-apart legs adjacent the second lateral edge, the legs having respective notches, the legs and respective notches extending outward from the outer surface and adapted to support the apparatus on a surface when the apparatus is used as a lower part of a container, and when the apparatus is used as an upper part of the container, the legs and notches face away from the surface and facilitate alignment with the container in a stacked formation, the legs and respective notches adapted to prevent the container from moving in a first direction with respect to the stacked formation; and four projections extending outward from the outer surface adjacent respective ones of the legs to further facilitate alignment of the container in the stacked formation and adapted to prevent the container from moving in a second direction with respect to the stacked formation.

11. The apparatus of claim 10 further comprising a plurality of slots and associated holes located on the first and second lateral edges and adapted to receive handles for lifting the container.

12. The apparatus of claim 10 further comprising a plurality of other holes located on the first and second lateral edges and adapted to receive connectors for securing the lower and upper parts of the container together.

13. The apparatus of claim 10 wherein the second contoured shape is different from the first contoured shape.

14. The apparatus of claim 10 wherein the inner surface further comprises a generally flat surface between the first contoured shape and the second contoured shape.

15. The apparatus of claim 10 wherein the inner surface further comprises ribs extending lengthwise between the first contoured shape and the second contoured shape.

16. The apparatus of claim 10 wherein the inner surface further comprises a cavity adjacent one end of the apparatus adapted to receive tubing extending from a dispensing end of the flexible bag of liquid.

17. The apparatus of claim 16 further comprising a space between the first and second lateral edges and adjacent the cavity, the space adapted to permit the tubing to extend externally from the apparatus.

18. A container for supporting a flexible bag of liquid comprising:

a lower part comprising a lower outer surface and first projections extending downward from the lower outer surface and adapted to support the lower part on a surface, a lower inner surface including side walls extending parallel to a longitudinal centerline of the inner surface and configured to support the flexible bag of liquid, and first and second contoured end projections extending directly upwardly from the inner surface and generally perpendicular to the longitudinal centerline of the inner surface, the first and second contoured end projections confronting each other along the longitudinal centerline of the inner surface and being configured to support opposite ends of the flexible bag with each of the first and second contoured end projections being spaced inwardly from the respective side walls; and an upper part configured to be placed over the lower part to form an interior space adapted to contain the flexible bag of liquid, the upper part comprising an upper outer surface and second projections extending upward from the upper outer surface, the second projections being substantially the same size, shape and relative location as the first projections, and the second projections adapted to be located adjacent to, and facilitate alignment with, first projections of another container in a stacked formation.

19. The container of claim 18 further comprising at least one handle extending through the lower part and the upper part for lifting the container.

20. The container of claim 19 wherein the handle comprises structure for securing the lower part and the upper part together.

21. The container of claim 18 further comprising at least one connector extending through the lower part and the upper part for securing the lower part to the upper part.

22. The container of claim 18 further comprising structure connected to each of the lower and the upper parts for aligning the lower and upper parts of a container in a juxtaposed relationship.

23. The container of claim 18 wherein each of the lower part and the upper part further comprise an inner surface and an outer surface, and the lower part and the upper part are stackable, with the outer surface of the upper part being placed in juxtaposition with the inner surface of the lower part.

24. The container of 18 wherein the upper part is substantially similar in size and shape to the lower part.

* * * * *

UNITED STATES PATENT AND TRADEMARK OFFICE

CERTIFICATE OF CORRECTION

PATENT NO. : 8,146,762 B2
APPLICATION NO. : 11/683838
DATED : April 3, 2012
INVENTOR(S) : Richard A. Leoncavallo et al.

It is certified that error appears in the above-identified patent and that said Letters Patent is hereby corrected as shown below:

In column 5, line 36, change "the pins 74 75 taper" to --the pins 74, 75 taper--.

In column 6, line 25, change "by a similarly interlocking relationships" to --by a similar interlocking relationship--.

In column 6, line 37, change "the relative locations of the legs is reversed." to --the relative locations of the legs are reversed.--.

In column 6, line 67, change "However, if such a stacking arrangement were used" to --However, if such a stacking arrangement was used--.

In column 8, line 42, change "The structure of the pans 20a-20n permit the containers" to --The structure of the pans 20a-20n permits the containers--.

In column 12, line 17, change "that have brought together to form a container." to --that have been brought together to form a container.--.

In column 14, line 30, change "and thickness may be easily be varied" to --and thickness may be easily varied--.

In column 15, line 55, change "are shown and described has having" to --are shown and described as having--.

In column 15, line 62, change "are illustrated as be supported" to --are illustrated as being supported--.

In claim 4, column 16, line 42, change "when the apparatus used as a lower part; and" to --when the apparatus is used as a lower part; and--, as appears in the Specification filed on March 8, 2007 at Page 18, claim 4, line 3.

Signed and Sealed this
Seventeenth Day of July, 2012

David J. Kappos

David J. Kappos
*Director of the United States Patent and Trademark Office*

In claim 23, column 18, line 49, change “wherein each of the lower part and the upper part further comprise an inner surface” to --wherein each of the lower part and the upper part further comprises an inner surface--.

In claim 24, column 18, line 55, change “The container of 18” to --The container of claim 18--.